US009862558B2

(12) United States Patent
Tahara et al.

(10) Patent No.: US 9,862,558 B2
(45) Date of Patent: Jan. 9, 2018

(54) SHEET FEEDING DEVICE AND IMAGE FORMING APPARATUS

(71) Applicant: KYOCERA Document Solutions Inc., Osaka (JP)

(72) Inventors: Mitsuhiro Tahara, Osaka (JP); Yuki Uohashi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/265,451

(22) Filed: Sep. 14, 2016

(65) Prior Publication Data

US 2017/0088373 A1 Mar. 30, 2017

(30) Foreign Application Priority Data

Sep. 30, 2015 (JP) ..... 2015-192601
Apr. 26, 2016 (JP) ..... 2016-088201
Aug. 22, 2016 (JP) ..... 2016-161776

(51) Int. Cl.
*B65H 5/00* (2006.01)
*B65H 3/06* (2006.01)
*G03G 15/00* (2006.01)
*G03G 21/16* (2006.01)

(52) U.S. Cl.
CPC ..... *B65H 3/0669* (2013.01); *B65H 3/0684* (2013.01); *G03G 15/6511* (2013.01); *G03G 15/6529* (2013.01); *G03G 21/1619* (2013.01); *B65H 2402/521* (2013.01); *B65H 2402/522* (2013.01); *B65H 2402/5221* (2013.01); *B65H 2402/52211* (2013.01); *B65H 2402/61* (2013.01); *B65H 2601/324* (2013.01);
(Continued)

(58) Field of Classification Search
CPC ..... B65H 3/0669; B65H 3/0676; B65H 2402/441; B65H 2402/521; B65H 2402/522; B65H 2402/5221; B65H 2402/52211; B65H 2601/324
See application file for complete search history.

(56) References Cited

U.S. PATENT DOCUMENTS 5,421,569 A * 6/1995 Davidson ..... B65H 3/0669 271/109
8,006,973 B2 * 8/2011 Toba ..... G03G 15/602 271/10.09

(Continued)

FOREIGN PATENT DOCUMENTS

JP 2001-294335 A 10/2001

*Primary Examiner* — Howard Sanders
(74) *Attorney, Agent, or Firm* — Studebaker & Brackett PC

(57) ABSTRACT

A sheet feeding device includes a feed roller, a feed holder, a supporting frame and a driving shaft. The feed roller is configured to rotate around a rotating shaft. The feed holder is configured to support the feed roller. The supporting frame has a storage recessed part in which the feed holder is attachable and detachable along a direction crossing an axial direction of the rotating shaft. The driving shaft is supported to the supporting frame on one side of the storage recessed part in the axial direction. The storage recessed part has a guide part and a positioning part. The guide part is configured to guide the feed holder. The rotating shaft is coupled to the driving shaft by sliding the feed holder positioned at the aligning position by the positioning part in the axial direction.

12 Claims, 22 Drawing Sheets

(52) U.S. Cl.
CPC ..... *G03G 2215/00396* (2013.01); *G03G 2215/0132* (2013.01)

(56) References Cited

U.S. PATENT DOCUMENTS

2013/0256971 A1* 10/2013 Ueyama ..... B65H 5/06
271/4.1
2017/0190528 A1* 7/2017 Uohashi ..... B65H 3/0661

* cited by examiner

SHEET FEEDING DEVICE AND IMAGE FORMING APPARATUS

INCORPORATION BY REFERENCE

This application is based on and claims the benefit of priorities from Japanese Patent applications No. 2015-192601 filed on Sep. 30, 2015, No. 2016-088201 filed on Apr. 26, 2016 and No. 2016-161776 filed on Aug. 22, 2016, the entire contents of which are incorporated herein by reference.

BACKGROUND

The present disclosure relates to a sheet feeding device configured to feed a sheet and an image forming apparatus including the sheet feeding device.

In an image forming apparatus such as a copying machine or a printer, a sheet on which an image is to be formed is fed by a sheet feeding device from a sheet feeding cartridge or the like to an image forming part. The sheet feeding device is provided with pickup roller, a feed roller and a retard roller. The pickup roller feeds out a sheet from the sheet feeding cartridge. The feed roller conveys the fed sheet to the image forming part. The retard roller conveys the sheet one by one without double feeding. These rollers come into contact with the sheet and thus are worn away by friction with the sheet. Since a sheet feeding failure occurs if such wearing advances, it is preferable for the rollers to be easily replaced and repaired.

A conveying path of the sheet fed from the sheet feeding device is different depending on the specification of the image forming apparatus. A conventional conveying path includes an S-path route and a rear face C-path route. The S-path route is formed such that a sheet is conveyed along a substantial S-shaped path toward a sheet ejecting device from the sheet feeding device disposed on a front side of the image forming apparatus. The rear face C-path route is formed such that a sheet is conveyed along a substantial C-shaped path on a rear face of the image forming apparatus at the time of duplex printing. In the case of the S-path route, since the retard roller is disposed in the sheet feeding cartridge while the pickup roller and the feed roller are disposed in an apparatus main body, the retard roller is easily separated from the pickup roller and the feed roller so that it makes easy to replace each of the rollers. However, in the case of the rear face C-path route, since these rollers are disposed on a rear face side of the apparatus main body, it is difficult to replace the rollers.

SUMMARY

In accordance with an embodiment of the present disclosure, a sheet feeding device includes a pickup roller, a feed roller, a feed holder, a supporting frame and a driving shaft. The pickup roller is configured to feed a sheet. The feed roller is configured to rotate around a rotating shaft so as to convey the sheet fed by the pickup roller. The feed holder is configured to support the pickup roller and the feed roller. The supporting frame has a storage recessed part in which the feed holder is supported so as to be attachable and detachable along a direction crossing an axial direction of the rotating shaft. The driving shaft is rotatably supported to the supporting frame on one side of the storage recessed part in the axial direction. The driving shaft is configured to be coupled to the rotating shaft so as to transmit a driving force to the rotating shaft. The storage recessed part has a first side wall, a second side wall, a guide part and a positioning part. The first side wall and the second side wall oppose to each other in the axial direction and extend along the attachment/detachment direction of the feed holder. The first side wall is on the one side in the axial direction and the second side wall is on the other side in the axial direction. The guide part is provided on each of the first side wall and the second side wall along the attachment/detachment direction and configured to slidably guide the feed holder. The positioning part is provided on either one of the first side wall and the second side wall and configured to position the feed holder guided along the guide part at an aligning position in which the driving shaft and the rotating shaft are aligned on the axis direction. The rotating shaft is coupled to the driving shaft by sliding the feed holder positioned at the aligning position by the positioning part in the axial direction.

In accordance with an embodiment of the present disclosure, an image forming apparatus includes the sheet feeding device, a conveying path and an image forming unit. The conveying path is configured such that a sheet fed by the sheet feeding device is conveyed. The image forming unit forms images on the sheet conveyed along the conveying path.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference to figures, an image forming apparatus and a sheet feeding device according to an embodiment of the present disclosure will be described.

Figure 1:
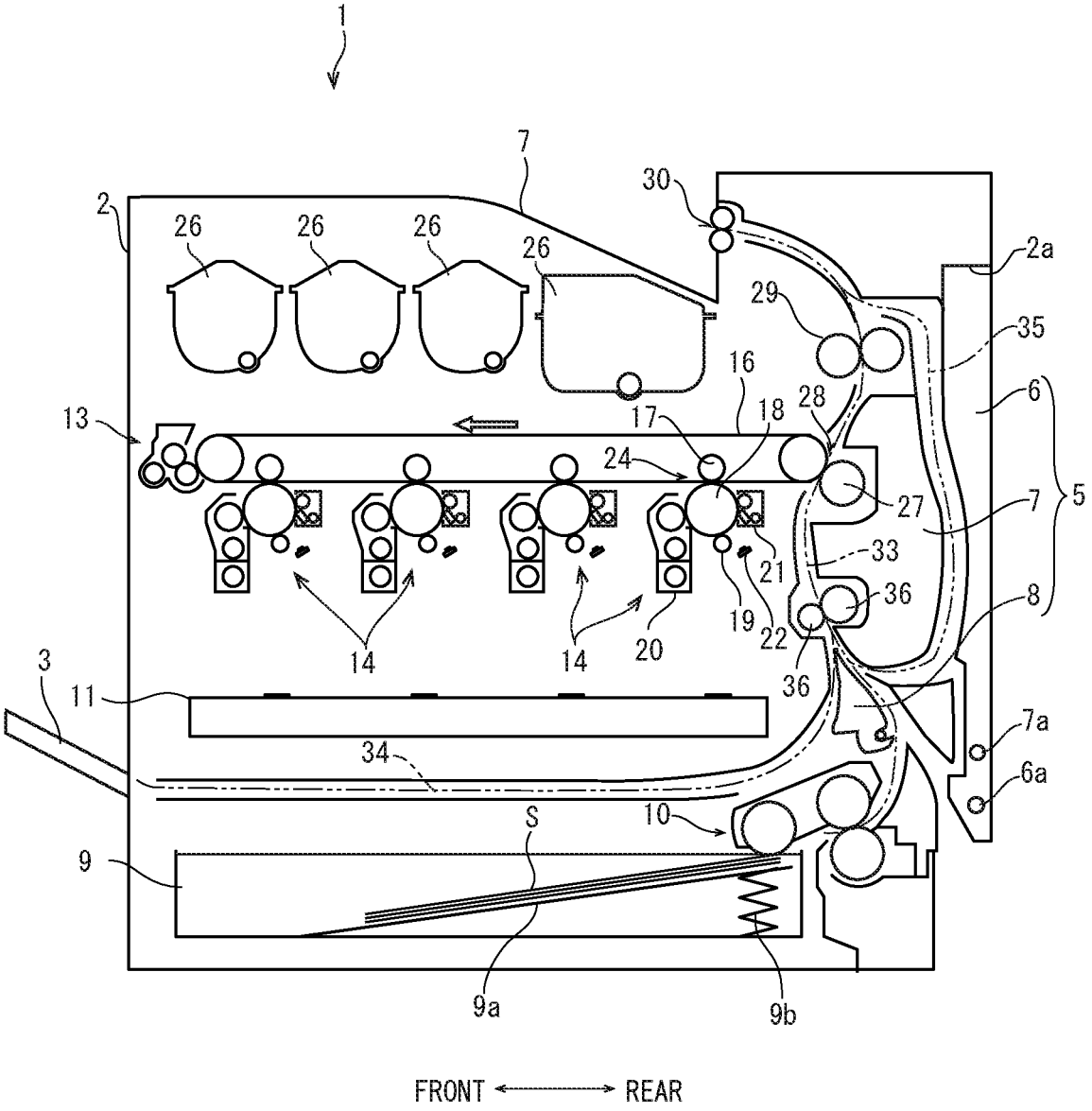
FIG. 1 is a view schematically showing an internal structure of a color printer according to an embodiment of the present disclosure.

First, with reference to FIG. 1, an entire structure of a color printer 1 as an image forming apparatus will be described. FIG. 1 is a perspective view showing the color printer. In the following description, a left side on the paper plane shows a front side of the color printer and left and right directions are based on a direction in which the color printer is viewed from the front side.

The color printer 1 has a box-shaped casing 2. On the front face of the casing 2, a manual bypass tray 3 is provided. On an upper face of the casing 2, a sheet ejecting tray 4 on which a sheet is ejected is formed. On the rear face of the casing 2, an opening 2*a* is formed. The opening 2*a* is opened and closed by an opening/closing unit 5. The opening/closing unit 5 has a rear cover 6 covering the opening 2*a*, a conveying unit 7 provided on an inside of the rear cover 6 and an intermediate guide 8 provided on an inside of the conveying unit 7. The rear cover 6 is supported by the casing 2 rotatably around a first supporting shaft 6*a* provided on its lower end. The conveying unit 7 is supported by the casing 2 rotatably around a second supporting shaft 7*a* positioned above the first supporting shaft 6*a*. The intermediate guide 8 is rotatably supported around the second supporting shaft 7*a*.

In the lower space of the casing 2, a sheet feeding cassette 9 configured to store a sheet S is detachably attached. The sheet feeding cassette 9 is provided with a lift plate 9*a* on which the sheet S is placed and a spring member 9*a* which biases the rear end portion of the lift plate 9*a* upward. Above the rear end portion of the sheet feeding cassette 9, a sheet feeding device 10 configured to feed the sheet S from the sheet feeding cassette 9 is provided. Above the sheet feeding cassette 9, an exposure device 11 having a laser scanning unit (LSU) is provided. Above the exposure device 11, an intermediate transferring unit 13 and four image forming units 14 are provided. The four image forming units 14 respectively corresponding four colors (Yellow, Magenta, Cyan and Black) of toner are arranged under the intermediate transferring unit 13.

The intermediate transferring unit 13 has an intermediate transferring belt 16 and four first transferring rollers 17. The intermediate transferring belt 13 circulates and rotates around a plurality rollers. The four first transferring rollers 17 are disposed in a hollow space of the intermediate transferring belt 16 along the left and right directions. Each of the image forming unit 14 has a rotatable photosensitive drum 18, a charger 19, a development device 20, a cleaning device 21 and an eliminator 22. The charger 19, the development device 20, the cleaning device 21 and the eliminator 22 are disposed around the photosensitive drum 14 along a rotating direction of the photosensitive drum 14. The photosensitive drum 14 faces the first transferring roller 17 via the intermediate transferring belt 16 between the development device 20 and the cleaning device 21. Between the photosensitive drum 14 and the intermediate transferring belt 16, a first transferring part 24 is formed. Above the intermediate transferring unit 13, four toner containers 26 respectively corresponding the four image forming units 14 are detachably attached.

On the rear side of the intermediate transferring unit 13, a second transferring roller 27 is rotatably supported by the conveying unit 7. Between the second transferring roller and the intermediate transferring belt 16, a second transferring part 28 is formed. Above the second transferring part 28, a fixing device 29 is provided. Above the fixing device 29, a sheet ejecting device 30 is provided so as to face the ejected sheet tray 4.

In the casing 2, a main conveying path 33, a manual bypass conveying path 34 and a duplex printing path 35 are formed. The main sheet conveying path 33 is formed so as to extend from the sheet feeding device 10, between the rear cover 6 and the intermediate guide 8 and then along the inside of the conveying unit 7. Along the main conveying path 33, the second transferring part 28, the fixing device 29 and the sheet ejecting device 30 are arranged in the order from the upstream side of the conveying direction. In addition, a resist roller pair 36 is provided on the main conveying path 33 on the upstream side from the second transferring part 28. The manual bypass conveying path 34 is formed so as to extend from the bypass tray 3, above the sheet feeding cassette 9 and along the intermediate transferring guide 8 and to join to the main conveying path 33 on the upstream side from the second transferring part 28. The duplex printing path 35 is formed so as to curve in a substantial C-shape between the rear cover 6 and the conveying unit 7 and then to join the main conveying path 33 on the upstream side from the resist roller pair 36.

Next, the operation of forming an image by the color printer 1 having such a configuration will be described. In each image forming unit 14, after a surface of the photosensitive drum 18 is charged by the charger 19, the exposure device 11 exposes the surface of the photosensitive drum 18 with a laser light based on an image date to form an electrostatic latent image on the surface of the photosensitive drum 18. The electrostatic latent image is then developed into a toner image of corresponding color toner by the development unit 20. The toner image is first transferred on a surface of the intermediate transferring belt 16 at the first transferring part 24. The above operation is performed at each image forming unit 14 to form a full color toner image on the intermediate transferring belt 16. The toner and charge remained on the photosensitive drum 18 are removed by the drum cleaning device 21 and the eliminator 22 respectively.

On the other hand, the sheet S fed from the sheet feeding cassette 9 by the sheet feeding device 10 is conveyed along the main conveying path 33 into the second transferring part 28 in a suitable timing with the above image forming operation. At the second transferring part 28, the full color toner image on the intermediate transferring belt 16 is second transferred on the sheet S. The sheet on which the toner image is transferred is conveyed along the sheet conveying path 33 into the fixing device 23. At the fixing device 29, the toner image is fixed on the sheet. The sheet with the fixed toner image is ejected from the sheet ejecting device 30 on the ejected sheet tray 4. At a duplex printing, a sheet formed an image on one face is conveyed from the duplex printing path 35 to the main conveying path 33 and an image is formed on the other face of the sheet. The sheet formed image on both faces is ejected by the sheet ejecting device 30. The sheet fed from the manual bypass tray 3 is conveyed from the manual bypass conveying path 34 to the main conveying path 33. Then, an image is formed in the same way.

When a jammed sheet on the main conveying path 33 is removed, the rear cover 6 and the conveying unit 7 are turned downward so as to open the main conveying path 33 on the downstream side from the sheet feeding device 10. When a jammed sheet on the manual bypass conveying path 34 is removed, the opening/closing unit 5 (the rear cover 6, the conveying unit 7 and the intermediate guide 8) is turned downward so as to open the manual bypass conveying path 34. The duplex printing path 35 is opened by turning the rear cover 6 downward.

Figure 2:
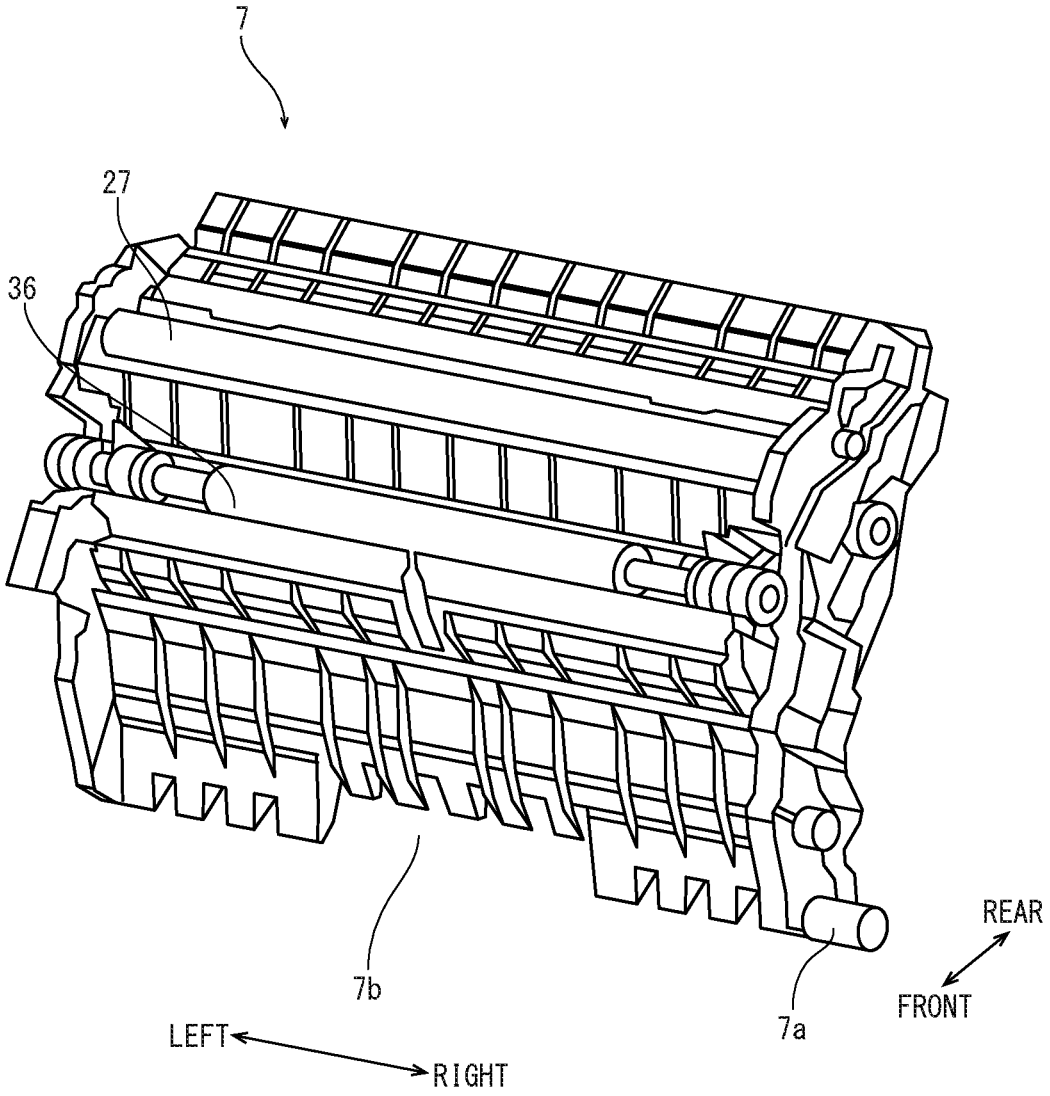
FIG. 2 is a perspective view showing a conveying unit of the color printer according to the embodiment of the present disclosure.

Next, with reference to FIG. 2 and FIG. 1, the conveying unit 7 will be described. FIG. 2 is a perspective view showing the conveying unit 7. As mentioned above, the conveying unit 7 is formed with the second supporting shafts 7*a* on the lower end portions of the left and right side faces. The second supporting shafts 7*a* are rotatably supported by bearing parts (not shown) provided on the casing 2 slightly above the first supporting shaft 6*a*. On the front face of the conveying unit 6, one guide face of the main conveying path 33 is formed by a plurality of ribs along the conveying direction. Also, on the front face, one roller 36 of the resist roller pair 36 and the second transferring roller 27 are rotatably supported at a predetermined interval in the conveying direction. On the rear face of the conveying unit 6, one guiding face of the duplex printing path 35 is formed by the plurality of ribs along the conveying direction.

Further, along the lower edge of the conveying unit 7, a rectangular notch 7*b* is formed at the center portion in the left and right directions. The notch 7*b* is formed so as to correspond to the sheet feeding device 10.

Figure 3:
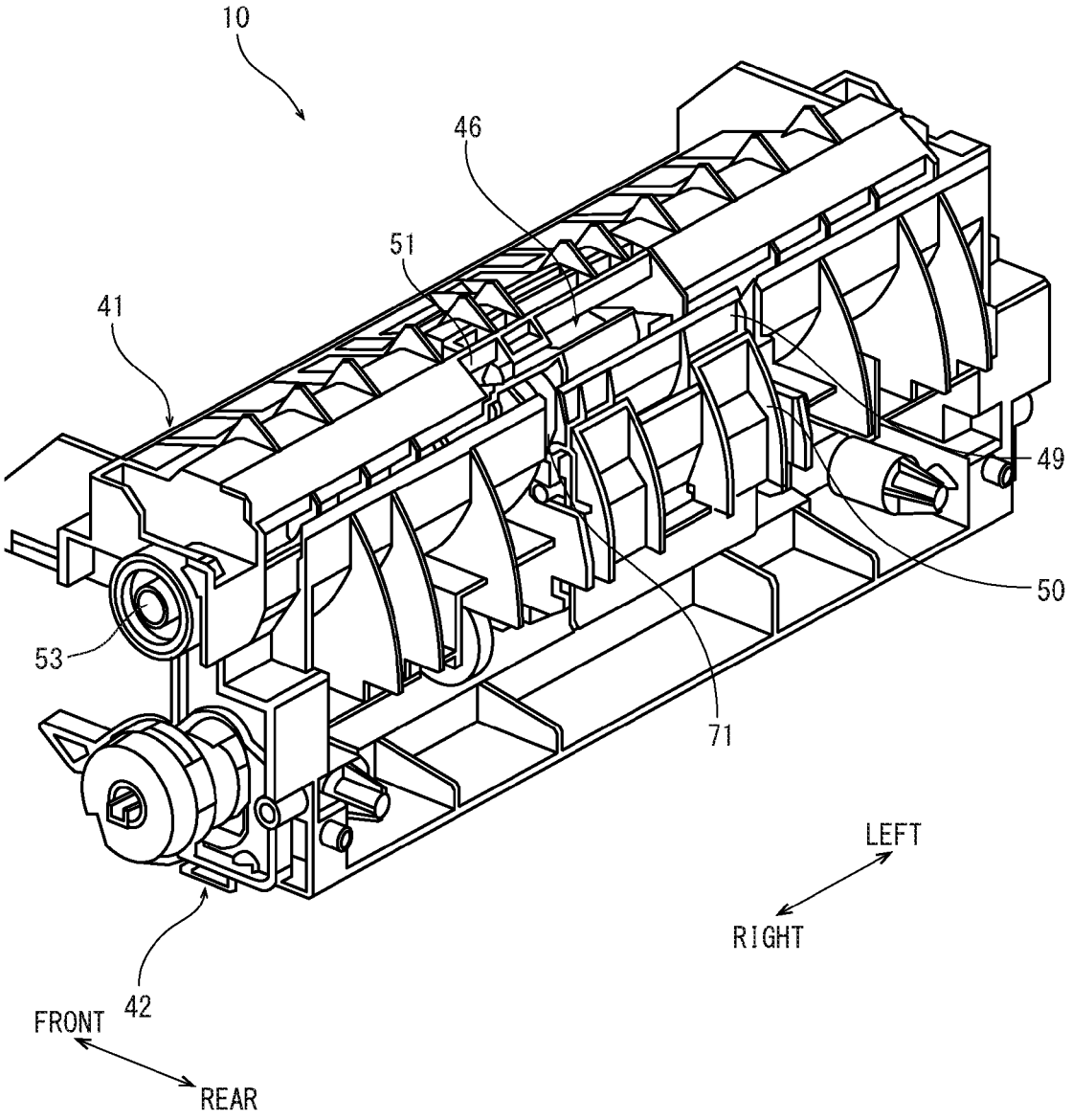
FIG. 3 is a perspective view showing a sheet feeding device according to a first embodiment of the present disclosure.
Figure 4:
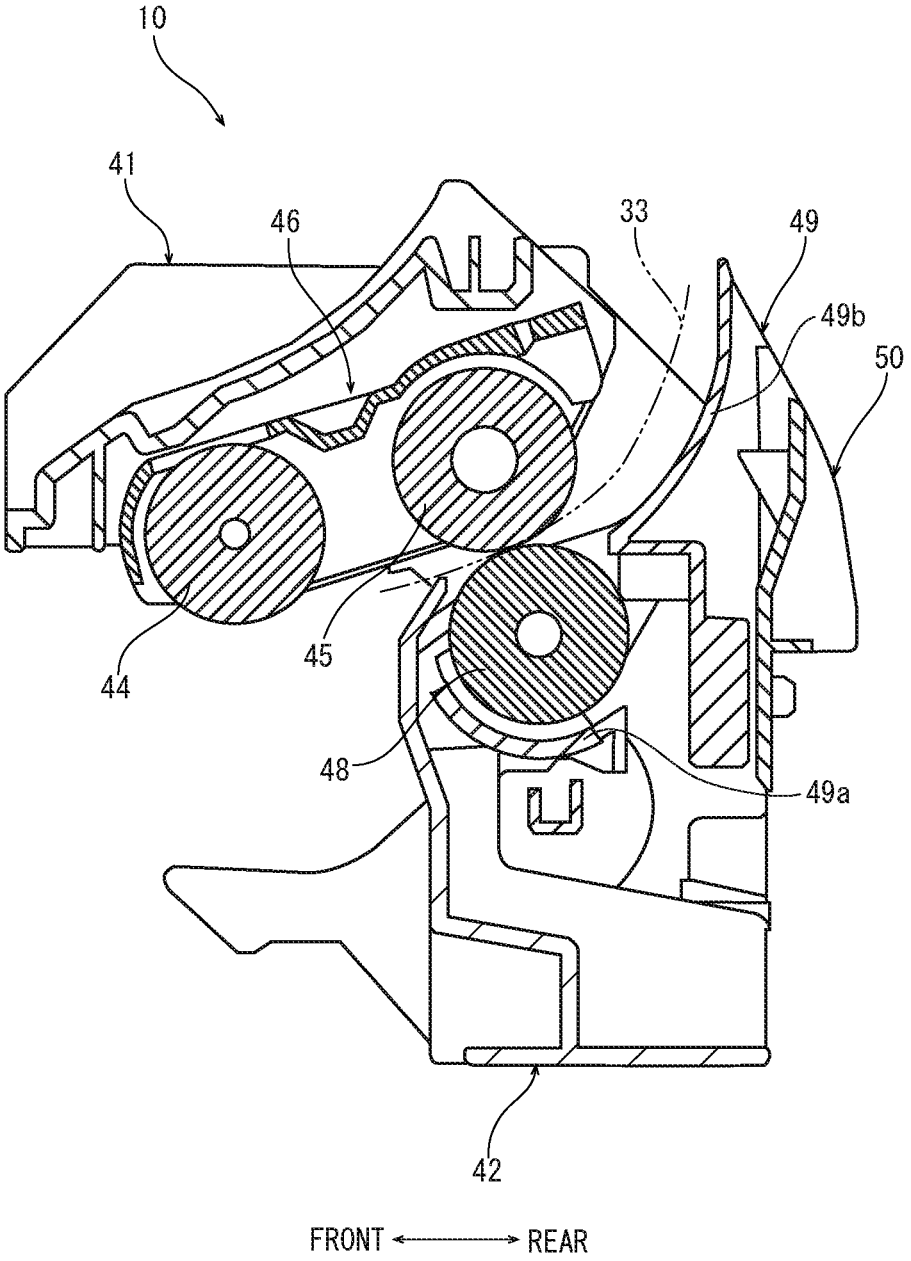
FIG. 4 is a sectional side view showing the sheet feeding device according to the first embodiment of the present disclosure.

Next, with reference to FIG. 3 and FIG. 4, the sheet feeding device 10 according to the first embodiment will be described. FIG. 3 is a perspective view showing the sheet feeding device 10, and FIG. 4 is a sectional side view showing the sheet feeding device 10.

The sheet feeding device 10 is provided with an upper supporting frame 41, a lower supporting frame 42, a feed holder 46, a retard holder 49 and a stopper 50. The upper supporting frame 41 and the lower supporting frame 42 are respectively disposed on an upper side and on a lower side of the main conveying path 33 (refer to FIG. 4). The feed holder 46 is detachably supported to the upper supporting frame 41. The retard holder 49 is detachably supported to the lower supporting frame 43. The stopper 50 is supported to the lower supporting frame 42 and prevents the retard holder 49 from being displaced. The feed holder 46 stores a pickup holder 44 and a feed roller 45 so as to be rotatable. The retard holder 49 stores a retard roller 48 so as to be rotatable.

Figure 5:
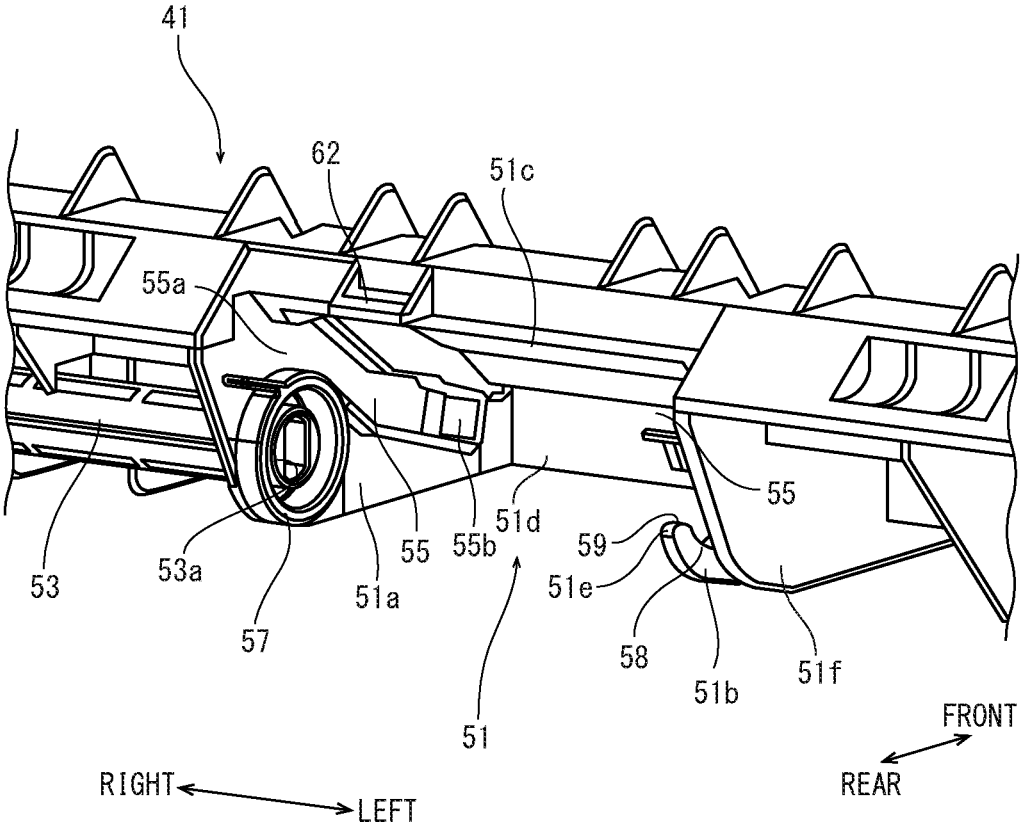
FIG. 5 is a perspective view showing a first side wall of an upper storage recessed part of an upper supporting frame in the sheet feeding device according to the first embodiment of the present disclosure.
Figure 6:
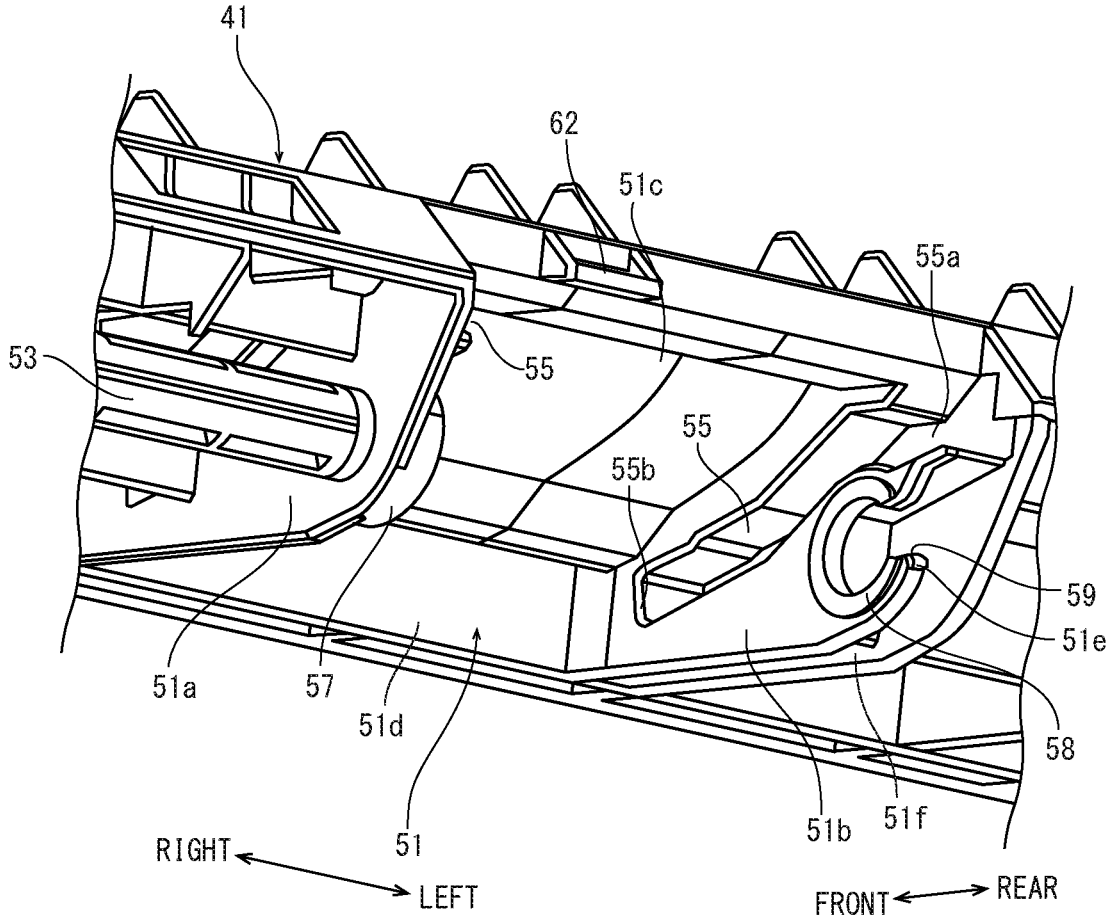
FIG. 6 is a perspective view showing a second side wall of the upper storage recessed part of the upper supporting frame in the sheet feeding device according to the first embodiment of the present disclosure.

With reference to FIG. 5 and FIG. 6, the upper supporting frame 41 will be described. FIG. 5 is a perspective view showing the upper storage recessed part viewed from the rear right side and FIG. 6 is a perspective view showing the upper storage recessed part viewed from the rear left side.

The upper supporting frame 41 is provided along a sheet width direction (the left and right directions) crossing the conveying direction. On the lower face of the upper supporting frame 41, a plurality of ribs inclined in an oblique upper direction toward the downstream side in the conveying direction are formed to form an upper guide face of the main conveying path 33. On the upper face of the upper supporting frame 41, a plurality of ribs inclined in an oblique upper direction toward the downstream side in the conveying direction are formed to form a lower guide face of the manual bypass conveying path 34.

On the lower face of the upper supporting frame 41, an upper storage recessed part 51 to which the feed holder 46 is detachably supported is formed at the center portion in the width direction. In the upper supporting frame 41, a driving shaft 53 which transmits a driving force to the feed roller 45 is rotatably supported on the right side of the upper storage recessed part 51 in the width direction (the left and right directions). As shown in FIG. 5, the driving shaft 53 is formed with an engagement hole 53*a* of an approximately oval cross-section at the tip end face. The engagement hole 53*a* is formed as an engaged part configured to be engaged an engagement protrusion 91 of the feed roller 45 as described later.

The upper storage recessed part 51 has a first side wall 51*a* and a second wall 51*b* which oppose to each other in the sheet width direction, a top wall 51*c* and a front wall 51*d* with a rear face (a face on the downstream side in the conveying direction) and a bottom face opened. The first side wall 51*a* is formed along the front and rear directions on a side of the driving shaft 53 (on one side) in an axial direction of the driving shaft 53. The second side wall 51*b* is formed along the front and rear directions on an opposite side to the driving shaft 53 (on the other side) in the axial direction. Further, the upper storage recessed part 51 has a third side wall 51*f* formed along the front and rear directions opposing the second side wall 51*b* on the other side of the second side wall 51*b* in the axial direction.

As shown in FIG. 5, the first side wall 51*a* on the one side in the axial direction of the driving shaft 53 (on the right side) is formed with a boss-shaped first bearing 57 at the rear end portion (the downstream side end portion in the conveying direction). Into the first bearing 57, the tip end portion of the driving shaft 53 enters. As shown in FIG. 6, the second side wall 51*b* on the other side in the axial direction (on the left side) is formed with a boss-shaped second bearing 58 at the rear end portion (the downstream side end portion of the conveying direction). The first bearing 57 and the second bearing 58 are arranged coaxially with each other. As described later, the second bearing 58 is formed as a positioning part configured to position the feed roller 45 on an aligning position where the feed roller 45 is coaxially aligned with the driving shaft 53. Along the rear edge 51*e* of the second side wall 51*b*, a notch 59 communicating with the second bearing 58 is formed. The notch 59 has a width smaller than an internal diameter of the second bearing 58.

Further, on the first side wall 51*a* and the second side wall 51*b*, guide grooves 55 are respectively formed above the first bearing 57 and the second bearing 58. The guide groove 55 is formed as a guide part configured to slidably guide the feed holder 46 along the front and rear directions (the conveying direction). The guide groove 55 extends forward (in the upstream direction in the conveying direction) from an opening end 55*a* to a closed end 55*b* in the downward oblique direction.

In addition, on the rear edge of the top wall 51*c* of the upper storage recessed part 51, a locking piece 62 protrudes rearward from a slightly right side portion of the center portion in the left and right directions. The locking piece 62 is formed as a locking part configured to lock a lever 79 (refer to FIG. 8) of the feed holder 46.

Figure 7:
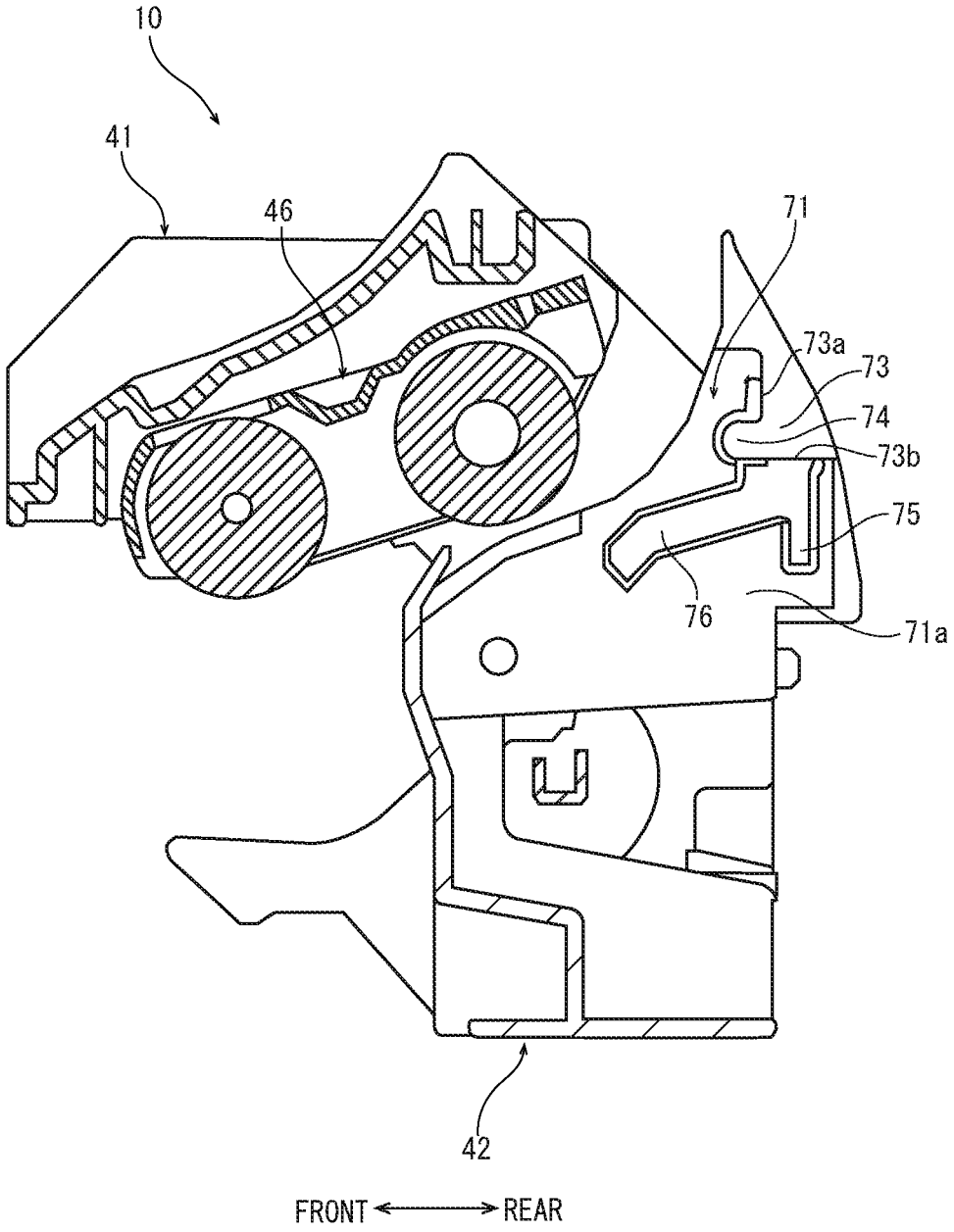
FIG. 7 is a sectional side view showing a lower storage recessed part of a lower support frame in the sheet feeding device according to the first embodiment of the present disclosure.

With reference to FIG. 3 and FIG. 7, the lower supporting frame 42 will be described. FIG. 7 is a side view showing the lower storage recessed part. The lower supporting frame 42 is provided along the sheet width direction. An upper face of the lower supporting frame 42 curves in an oblique upper direction toward the downstream side in the conveying direction to form a lower guide face of the main conveying path 33. At the center portion in the sheet width direction of the lower supporting frame 42, a lower storage recessed part 71 with a rear face and an upper face opened is formed. The lower storage recessed part 71 opposes on a lower right side of the upper storage recessed part 51.

The lower storage recessed part 71, as shown in FIG. 7, has a pair of side walls 71*a* which oppose to each other in the sheet width direction. In a substantially upper halve portion of each side wall 71*a*, a substantially right-angled triangle shaped notch 73 is formed. At a lower portion of a perpendicular edge 73*a* of the notches 7, a hemispheric engaging depression 74 is formed. Further, each of the side walls 71*a* is formed with a first groove 75 and a second groove 76. The first groove 75 extends downward straightly from a horizontal edge 73*b* of the notch 73. The second groove 75 extends forward in an oblique downward direction from a front side portion from the first groove 74 of the horizontal edge 73*b*.

Figure 8:
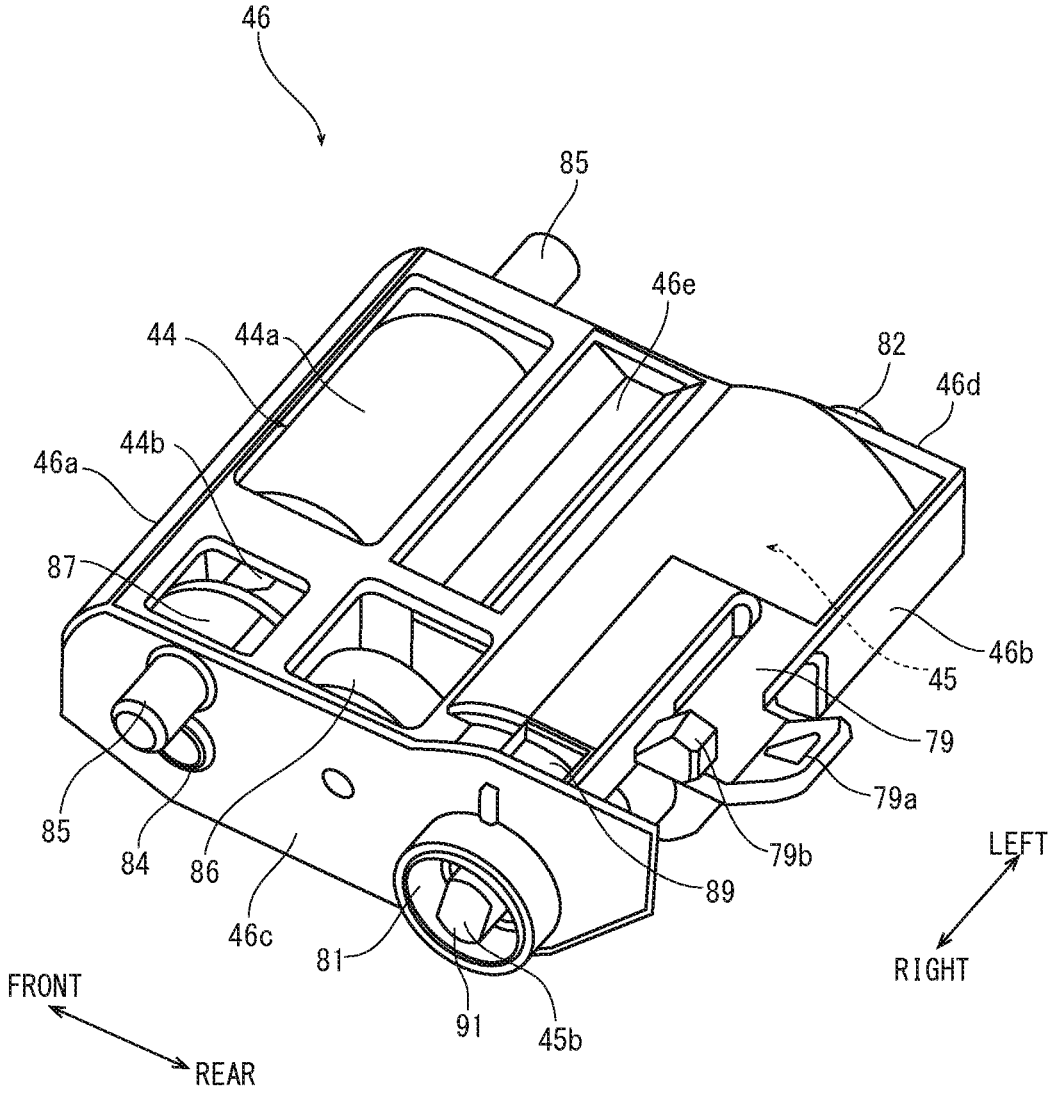
FIG. 8 is a perspective view showing a feed holder of the sheet feeding device according to the first embodiment of the present disclosure.

Next, with reference to FIG. 8 and FIG. 9A and FIG. 9B, the feed holder 46 will be described. FIG. 8 is a perspective view showing the feed holder, FIG. 9A is a perspective view showing a first boss of the feed holder and FIG. 9B is a perspective view showing a second boss of the feed holder.

As shown in FIG. 8, the feed holder 46 is a substantially parallelepiped-shaped boxy member. The feed holder 46 has: a front plate 46*a* and a rear plate 46*b*; a first side plate 46*c* and a second side plate 46*d* which oppose to each other in the sheet width direction; and a top plate 46*e*, A bottom face of the feed holder 46 is opened. In the right halve of the corner between the top plate 46*e* and the rear plate 46*b*, a notch is formed. The top plate 46*e* is formed with a lever 79 protruding rightward in the notch. The lever 79 is formed as a locked part configured to be locked with the locking piece 62 (refer to FIG. 5 and FIG. 6) of the upper storage recessed part 51.

At the tip end portion of the lever 79, a press-down piece 79*a* protruding rearward and a locked protrusion 79*b* protruding upward are formed.

Figure 9A:
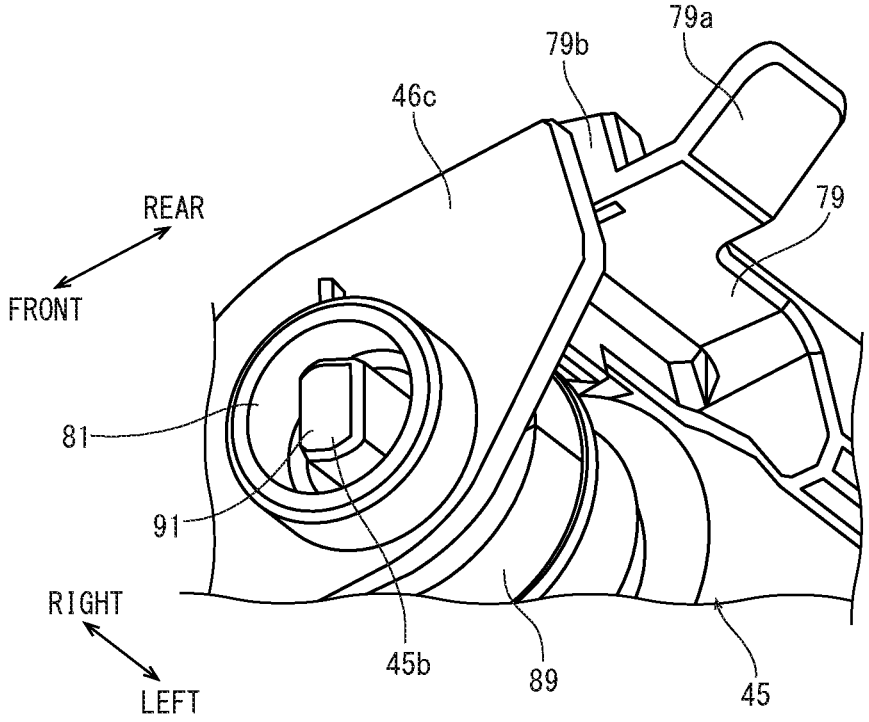
FIG. 9A is a perspective view showing a first boss of the feed holder in the sheet feeding device according to the first embodiment of the present disclosure.
Figure 9B:
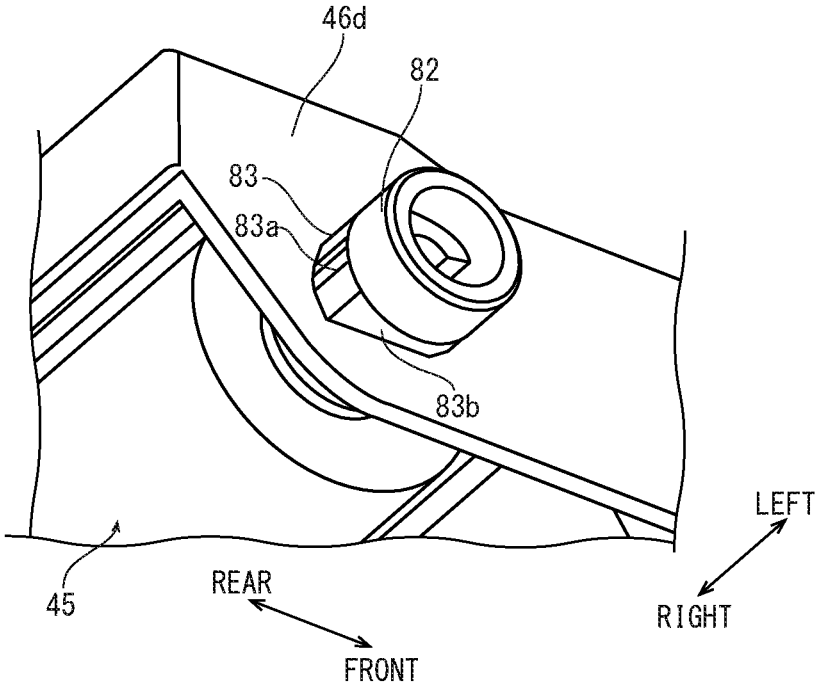
FIG. 9B is a perspective view showing a second boss of the feed holder in the sheet feeding device according to the first embodiment of the present disclosure.

The first side plate 46*c* and the second side plate 46*d*, as shown in FIG. 9A and FIG. 9B, are respectively formed with a first boss 81 and a second boss 82 at rear portions (the downstream side end portions in the conveying direction). The first boss 81 and the second boss 82 are arranged coaxially with each other. The first boss 81 and the second boss 82 each have a cylindrical shape which has an outer diameter capable of engaging into the first bearing 57 and the second bearing 58 (refer to FIG. 5 and FIG. 6) formed in the first side wall 51*a* and the second side wall 51*b* of the upper storage recessed part 51, respectively.

As shown in FIG. 9B, at the proximal end portion of the second boss 82, a small diameter part 83 of an oval-shaped cross section is formed. The small diameter part 83 has a pair of curved side faces 83*a* and a pair of flat side faces 83*b*. The pair of curved side faces 83*a* curve in an arc shape along an outer circumference face of the second boss 82. The pair of flat side faces 83*b* are formed by cutting the second boss 82 at parallel planes to the axial direction of the second boss 82. The pair of curved side faces 83*a* has an outer diameter capable of being clearance-fitted into the second bearing 58. A distance between the pair of flat side faces 83*b* is equal to a width of the notch 59 (refer to FIG. 5) of the second bearing 58. In this manner, the small diameter part 83 is capable of passing through the notch 59.

As shown in FIG. 8, in the front portions (the upstream side end portions in the conveying direction) of the first side plate 46*c* and the second side plate 46*d*, pickup roller bearing openings 84 to which the pickup roller 44 is to be rotatably supported are coaxially formed. Also, on the outer faces of the first side plate 46*c* and the second side plate 46*d*, guide shafts 85 protruding in the opposite directions each other are coaxially formed above each of the pickup roller bearing openings 84.

Further, on the inner face of the first side plate 46*c*, an idle gear 86 is rotatably supported between the pickup roller bearing opening 84 and the first boss 81.

The pickup roller 44 has: a cylindrical roller main body 44*a*; and a rotating shaft 44*b* provided on the axial center of the roller main body 44*a*. At an end portion on one side (the right side) of the rotating shaft 44*b*, a gear 87 which meshes with the idle gear 86 is fixed. Both end portions of the rotating shaft 44*b* are rotatably supported in the pickup roller bearing openings 84 of the feed holder 46. The both end portions of the rotating shaft 44*b* slightly protrude from the first side plate 46*c* and the second side plate 46*d* of the feed holder 46 and are prevented from being removed by stopping members such as C-rings. Protrusion lengths of the both end portions of the rotating shaft 44*b* from the first side plate 46*c* and the second side plate 46*d* are shorter than a protrusion length of the guide shafts 85.

The feed roller 45 has: a cylindrical roller main body 45*a*; and a rotating shaft 45*b* provided on the axial center of the roller main body 45*a*. At an end portion on one side (the right side) of the rotating shaft 45*b*, a gear 89 which meshes with the idle gear 86 is fixed. Both end portions of the rotating shaft 45*b* respectively penetrate through the first boss 81 and the second boss 82. On an end face of the one side (the right side) of the rotating shaft 45*b*, an engagement protrusion 91 of an oval-shaped cross section is formed. The engagement protrusion 91 is formed as an engaging part capable of engaging with the engagement hole 53*a* of the driving shaft 53.

The retard holder 49 will be described with reference to FIG. 4. The retard holder 49 has a supporting part 49*a* to which the retard roller 38 is supported and a guide part 49*b* provided on the downstream side in the conveying direction of the supporting part 49*a*. The rear edge of the guiding part 49*b* curves upward in the oblique right direction along the conveying direction to form the lower guide face of the main conveying path 33, as with the upper face of the lower supporting frame 42. The guiding part 49*b* is formed with protrusions (not shown) which respectively engage with the engagement depression 74 and the second groove 76 formed in the lower storage recessed part 71 of the lower supporting frame 42. If the retard holder 49 is slid into the lower storage recessed part 71 from the oblique rear upper direction, the protrusions engage with the engagement depression 74 and the second gap 76, respectively.

The retard roller 48 is rotatably supported to a rotating shaft via a torque limiter. The retard roller 48 stops the rotation until a toque exceeding a predetermined torque is applied; while idles with respect to the rotating shaft if the torque exceeding to the predetermined toque is applied. Namely, if the torque exceeding the predetermined torque is applied, the retard roller 48 is driven by the pickup roller 44 to be rotated and to feed an uppermost sheet separated from another sheets.

The stopper 50 is formed with a protrusion (not shown) which engages with the first groove 75 formed in the lower storage recessed part 71 of the lower supporting frame 42. If the stopper 50 is slid into the lower storage recessed part from the upper side, the protrusion engages with the first groove 75 and then is attached to the lower storage recessed part 71. In this manner, the stopper 50 prevents the retard holder 49 from being removed. A detailed description of the retard holder 49 and the stopper 50 is omitted.

Figure 10A:
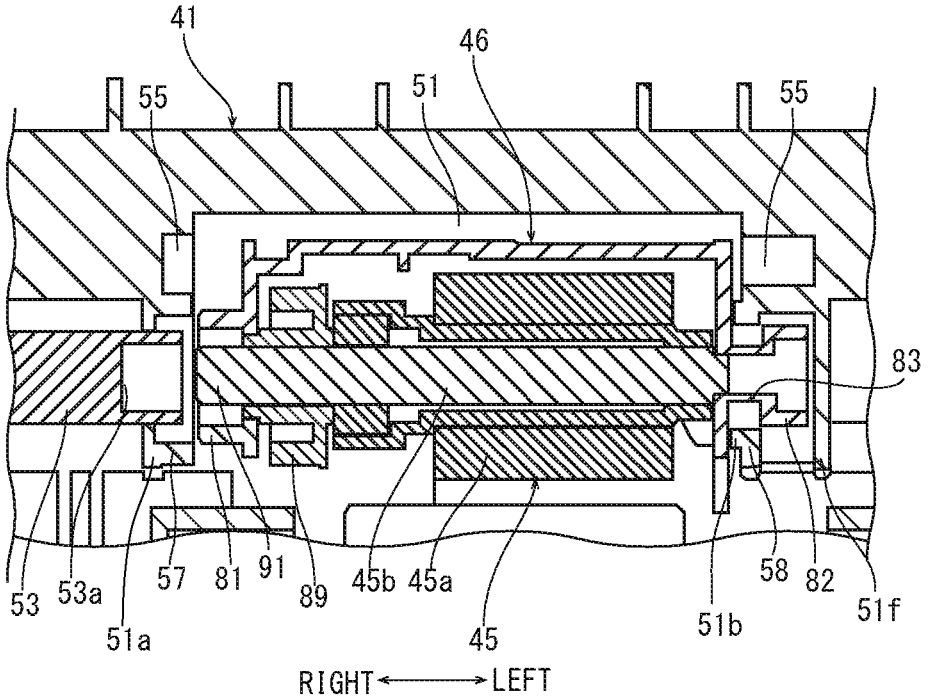
FIG. 10A is a sectional view showing a rotating shaft and a driving shaft which are positioned at an aligning position, sectioned along the rotating shaft viewed from a rear side, in the sheet feeding device according to the first embodiment of the present disclosure.
Figure 10B:
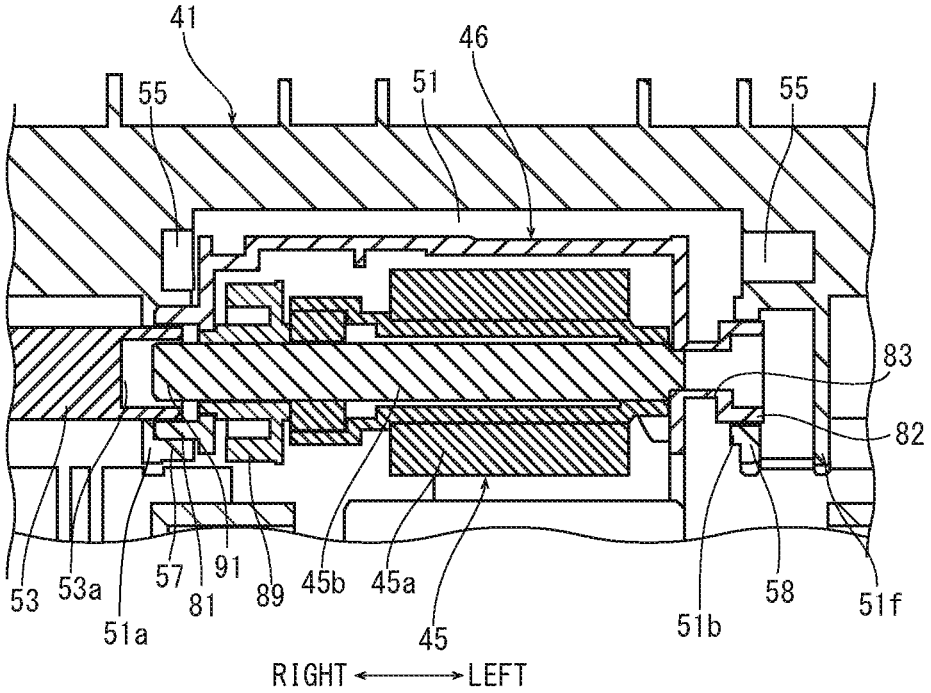
FIG. 10B is a sectional view showing the rotating shaft and the driving shaft which are coupled to each other, sectioned along the rotating shaft viewed from the rear side, in the sheet feeding device according to the first embodiment of the present disclosure.
Figure 11:
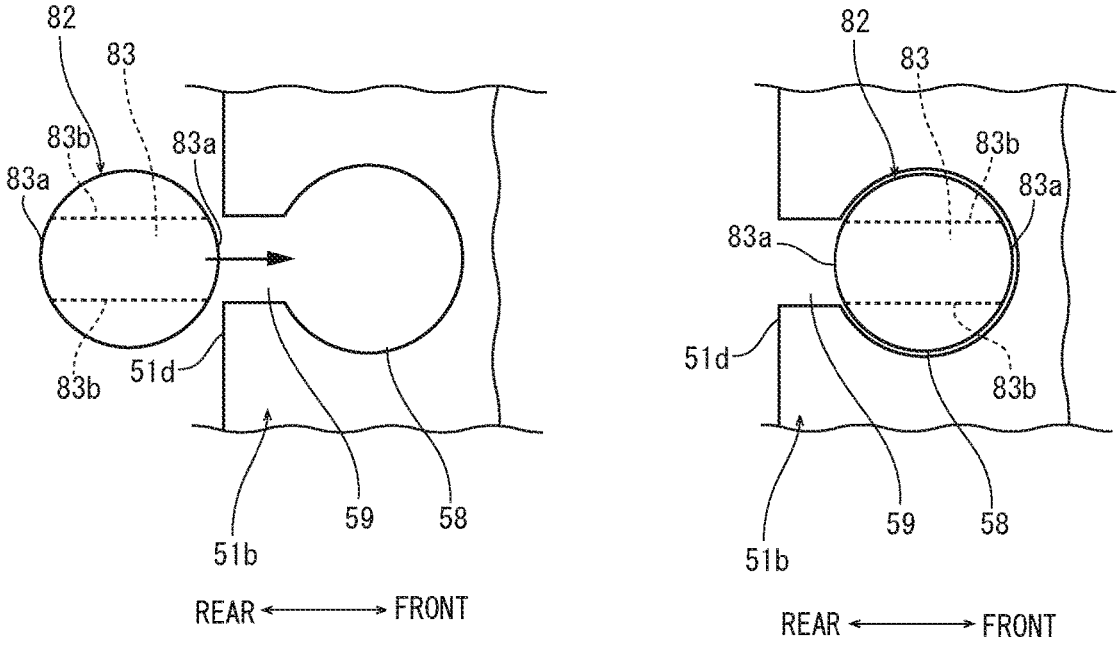
FIG. 11 is a view showing a state in which the first boss is positioned to a first bearing, viewed from an axial direction of the first boss, in the sheet feeding device according to the first embodiment of the present disclosure.
Figure 12:
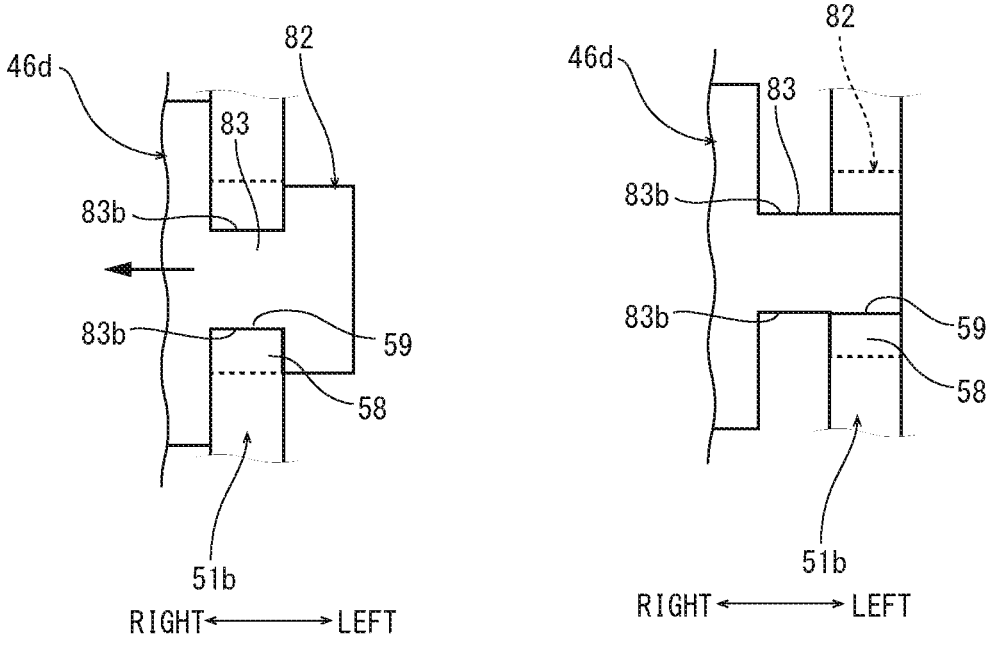
FIG. 12 is a view showing a state in which the first boss is fitted into the first bearing, viewed from a direction perpendicular to the axial direction of the first boss, in the sheet feeding device according to the first embodiment of the present disclosure.
Figure 13:
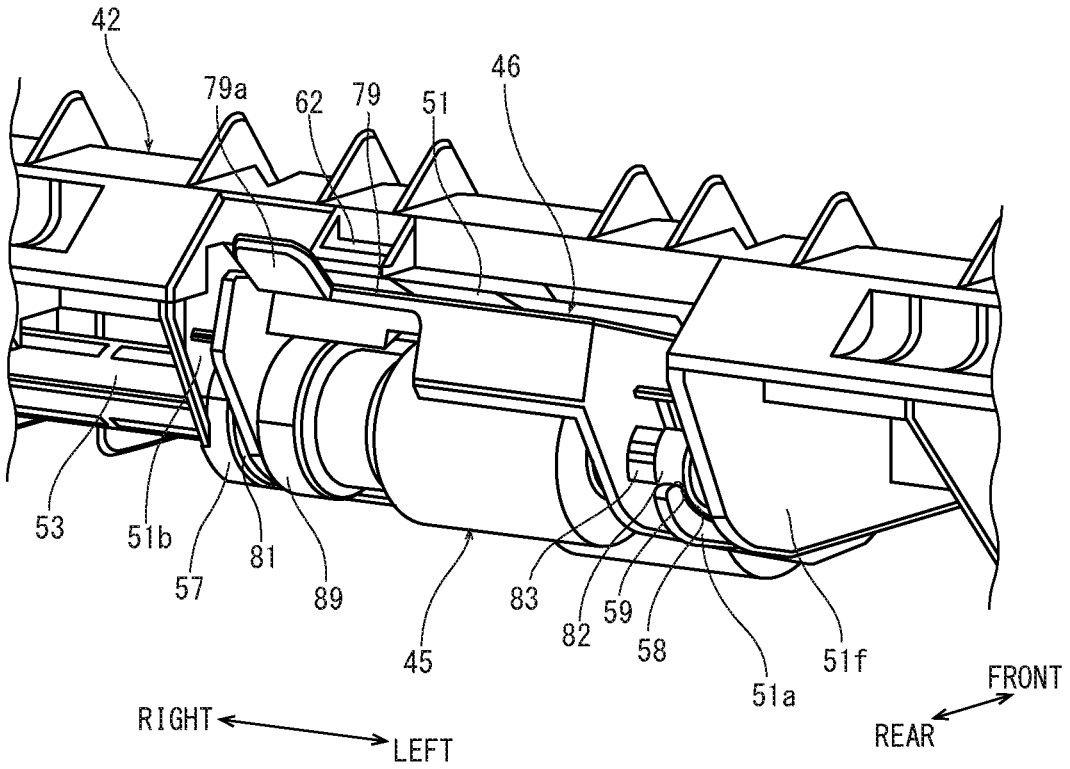
FIG. 13 is a perspective view showing the feed holder stored in the upper storage recessed part viewed from a rear left side, in the sheet feeding device according to the first embodiment of the present disclosure.
Figure 14:
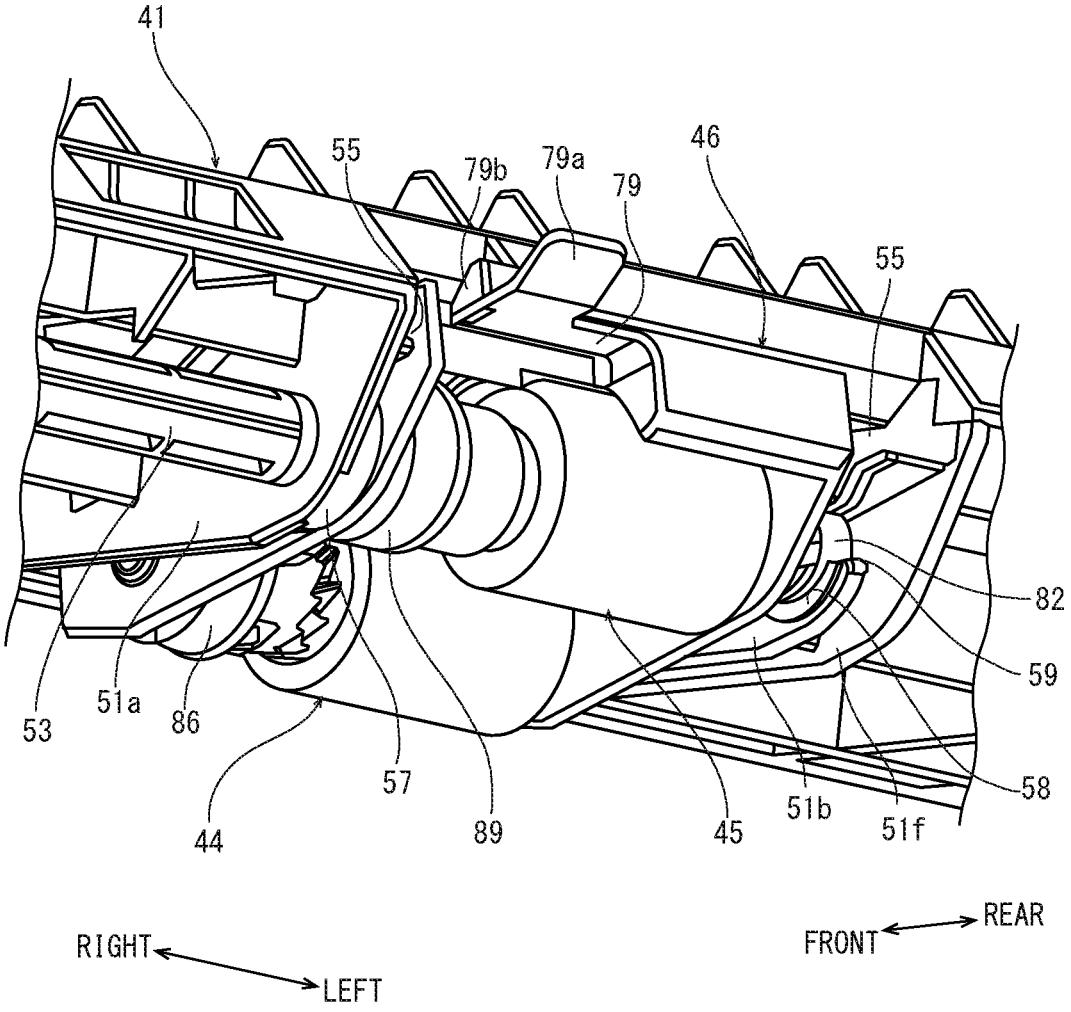
FIG. 14 is a perspective view showing the feed holder stored in the upper storage part viewed from a rear right side, in the sheet feeding device according to the first embodiment of the present disclosure.

With reference to FIG. 10A, FIG. 10B, and FIG. 11 to FIG. 14, a method of attaching the feed holder 46 to the upper storage recessed part 51 in the sheet feeding device 10 having the above construction will be described. FIG. 10A is a view showing the rotating shaft and the driving shaft which are positioned at the aligning position, sectioned along the rotating shaft, viewed from the rear side; and FIG. 10B is a view showing the rotating shaft and the driving shaft which are coupled to each other, sectioned along the rotating shaft, viewed from the rear side. FIG. 11 is a view showing a state in which the second boss is positioned in the second bearing, viewed from the axial direction of the second boss; and FIG. 12 is a view showing a state in which the second boss is fitted into the second bearing, viewed from a direction perpendicular to the axial direction. FIG. 13 is a perspective view showing the feed holder stored in the upper storage recessed part, viewed from the rear left side; and FIG. 14 is a perspective view showing the feed holder stored in the upper storage recessed part, viewed from the rear right side.

First, after opening the aperture 2*a* of the apparatus main body 2 by turning the rear cover 6 (refer to FIG. 1) rearward, the conveying unit 7 is turned rearward. Then, through the notch 7*b* (refer to FIG. 2) formed along the lower edge of the conveying unit 7, the upper storage recessed part 51 and the lower storage recessed part 71 are exposed.

Afterwards, through the notch 6*b*, the feed holder 46 is attached to the upper storage recessed part 51. First, two guide shafts 65 (refer to FIG. 8) are respectively engaged with the guide grooves 55 (refer to FIG. 5 and FIG. 6) from the opened ends 55*a* of the first side wall 51*a* and the second side wall 51*b*. At this time, although the both end portions of the rotating shaft 44*b* of the pickup roller 44 protrude from the pickup roller bearing aperture 84, since the protrusion length thereof is short, the both end portions do not interfere with the first bearing 57 and the second bearing 58.

If the guide shafts 85 are slid along the guide grooves 55, as shown in FIG. 11, the small diameter part 83 of the second boss 82 then gets into the second bearing 58 through the notch 59. Then, one of the pair of curved side faces 83*a* abuts against the inner circumferential face of the second bearing 58. In this manner, the sliding of the feed holder 46 is restricted. In addition, as shown in FIG. 10A, the feed holder 46 is positioned at the aligning position where the rotating shaft 45*b* of the feed roller 45 and the driving shaft 53 are arranged in the axial direction.

Next, the feed holder 46 is slid rightward (in one axial direction of the rotating shaft 45*b*) while the lever 79 is elastically deformed downward by pressing the press-down piece 79*a* (refer to FIG. 8) downward and then, as shown in FIG. 12, the second boss 82 engages with the second bearing 58. Since the outer diameter of the second boss 82 is larger than the width of the notch 59, the second boss 82 is prevented from coming off. Then, as shown in FIG. 10B, the first boss 81 is fitted into the first bearing 57 while the engagement protrusion 91 of the rotating shaft 45*b* engages with the engagement hole 53*a* of the driving shaft 53. Then, the rotating shaft 45*b* and the driving shaft 53 are coupled to each other so as to be integrally rotatable.

Afterwards, if the pressing of the press-down piece 79*a* downward is released, as shown in FIG. 13 or FIG. 14, the locked protrusion 79*b* of the lever 79 is locked with the locking piece 62 and then the sliding of the feed holder 46 leftward is restricted. Incidentally, at the aligning position, the guide shafts 85 do not abut against the closed ends 55*b* of the guide grooves 55.

After the feed holder 46 is thus attached to the upper storage recessed part 51, the retard holder 49 is attached to the lower storage recessed part 71. When the retard roller 48 is attached to the lower storage recessed part 71 from the oblique upper side through the notch 7*a*, the protrusions of the guide part 49*b* respectively engage with the engagement depression 74 and the second groove 76 (refer to FIG. 7). Also, the supporting part 49*a* is biased by a biasing member (not shown) in the clockwise direction of FIG. 3 and then the retard roller 48 is pressed against the feed roller 45.

Next, the stopper 50 is attached to the lower storage recessed part 71 from the upper side through the notch 7*a* and then the protrusion is engaged with the first groove 75. In this manner, the movement of the retard holder 49 is restricted. Lastly, after turning the conveying unit 7, the rear cover 6 is turned to thereby close the opening 2*a*.

If the feed holder 46 and the retard holder 49 are attached, the uppermost sheet S among the sheets stacked on the lift plate 9*a* biased upward by the spring member 9*b* of the sheet feeding cassette 9 is brought into pressure contact with the pickup roller 44 stored in the feed holder 46.

In a case where only one sheet S is fed by the pickup roller 44, the sheet S is conveyed along the main conveying path 33 by the feed roller 45. On the other hand, in a case where two or more sheets S are fed by the pickup roller 44, the uppermost sheet is conveyed by the feed roller 45. However, since a frictional force between the uppermost sheet S and a lower sheet is smaller than a frictional force between the lower sheet and the retard roller 48 and thus a torque exceeding a predetermined torque is not applied to the retard roller 48, the retard roller 48 does not rotate and the lower sheet is therefore not conveyed. Thus, two or more sheets are appropriately separated and then only the uppermost S is conveyed on the downstream side.

Figure 15:
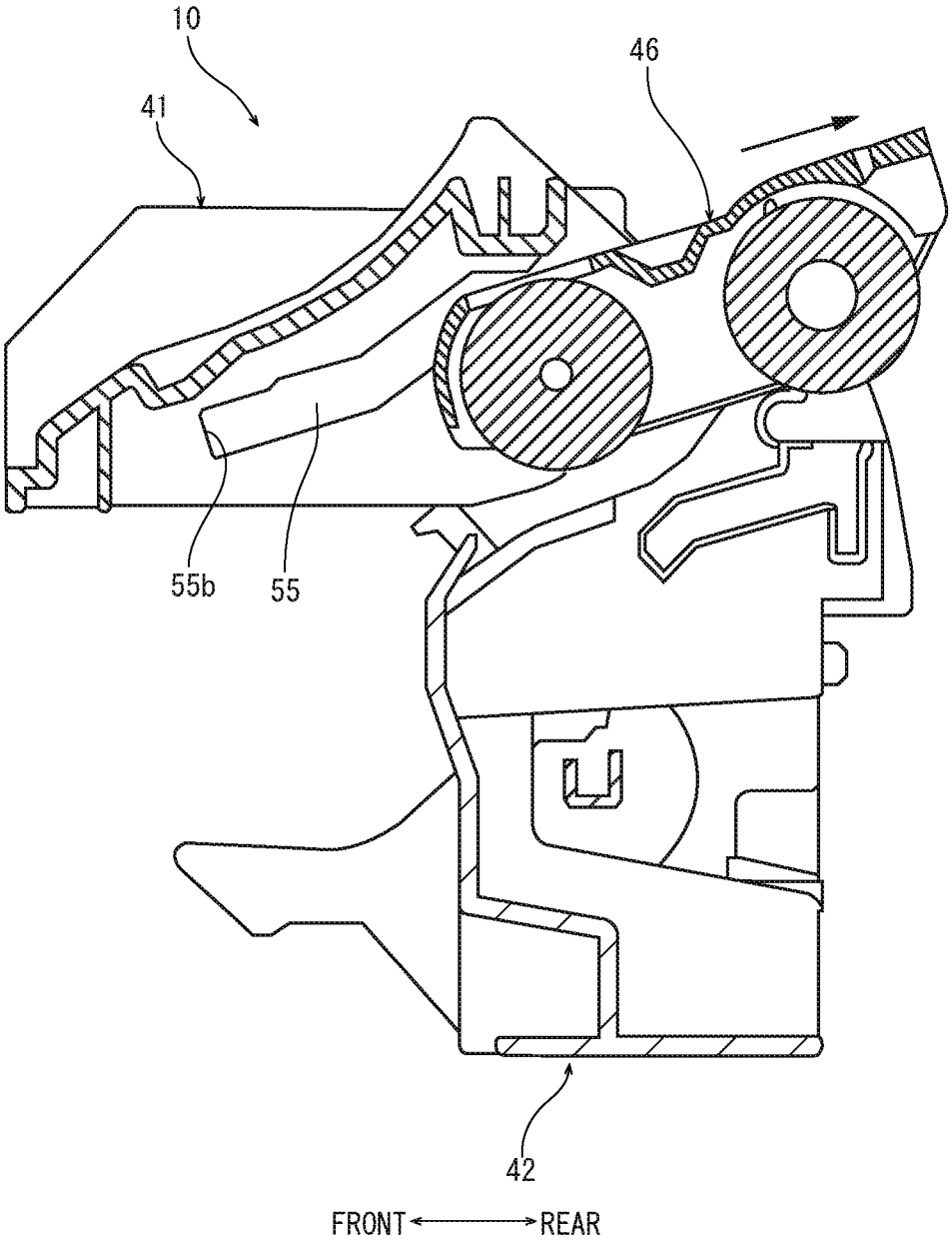
FIG. 15 is a sectional side view showing a state in which the feed holder is detached from the upper storage recessed part, in the sheet feeding device according to the first embodiment of the present disclosure.

Next, with reference to FIG. 10A, FIG. 10B, FIG. 12 and FIG. 15, a procedure for removing the feed holder 46 will be described. FIG. 15 is a sectional side view showing a state in which the feed holder is removed from the upper storage recessed part.

After opening the opening 2*a* by turning the rear cover 5 and then turning the conveying unit 6, through the notch 7*b* of the conveying unit 7, the stopper 50 is slid in the upper direction and then is removed from the lower storage recessed part 71. Subsequently, the retard holder 49 is slid in the oblique rear upper direction and then is removed from the lower storage recessed part depression 71.

Next, the feed holder 46 is removed from the upper storage recessed part 51. At this time, after the lever 79 is elastically deformed downward by pressing the press-down piece 79*a* downward to thereby unlock the locked protrusion 79*b* and the locking piece 62 from each other, the feed holder 46 is slid leftward. Then, as shown in FIG. 10A or FIG. 12, the second boss 82 of the feed holder 46 is spaced from the second bearing 58 leftward and then the small diameter part 83 gets into the second bearing 58. Also, the first boss 81 is spaced from the first bearing 57 leftward and then the engagement protrusion 91 of the rotating shaft 45*b* of the feed roller 45 disengages from the engagement hole 53*a* of the driving shaft 53.

Next, as shown in FIG. 15, if the feed holder 46 is pulled out upward in the oblique rear direction, the guide shafts 85 slid rearward along the guide grooves 55. Then, the small diameter part 83 of the second boss 82 disengages from the second bearing 58 through the notch 59. In this manner, the feed holder 46 is detached from the upper storage recessed part 51.

As described hereinabove, in the sheet feeding device 10 of the present disclosure, if the guide shafts 85 of the feed holder 46 are slid in the forward direction, that is, in the direction orthogonal to the axial direction of the rotating shaft 45*b* of the feed roller 45, along the guide grooves 55 in the upper storage recessed part 51, the rotating shaft 45*b* of the feed roller 45 is positioned at the aligning position to be axially aligned with the first bearing 57 of the first side wall 51*a*, the second bearing 58 of the second side wall 51*b* and the driving shaft 53. Therefore, the rotating shaft 45*b* of the feed holder 46 and the driving shaft 53 can be easily positioned in the axial direction.

In addition, after positioning the rotating shaft 45*b* and the driving shaft 53 in the axial direction, if the feed holder 46 is slid in the leftward direction, that is, in one side direction of the axial direction of the rotating shaft 45*b*, the rotating shaft 45*b* is coupled to the driving shaft 53 and also the feed holder 46 is prevented from being displaced from the upper storage recessed part 51. Namely, since the feed holder 46 can be attached or detached by the linear sliding operations, the workability of repair or replacement of each roller can be enhanced.

Further, the second boss 82 formed with the small diameter part 83 and the second bearing 58 which supports the second boss 82 make it possible to position the rotating shaft 45*b* and the driving shaft 53 at the aligning position and to prevent the feed holder 46 from being displaced from the upper storage recessed part 51. Therefore, it becomes possible to position and attach or detach the feed holder 46 with a simple construction. Incidentally, the small diameter part 83 may be formed in any shape as long as it is possible to pass through the notch 59 formed in the second bearing 58 and to abut against the inner circumferential face of the first bearing 57 at the aligning position. As such a shape, for example, a sectional D-shape can be formed.

Further, the notch 7*b* of the conveying unit 7 makes it possible to enlarge an access allowable space to the upper storage recessed part 51 and the lower storage recessed part 71 from the rear face side of the apparatus main body 2. Accordingly, the work of attaching or detaching the stopper 50, the retard holder 49 and the feed holder 46 can be more easily carried out. Furthermore, since the feed holder 46 is detached after detaching the stopper 50 and the retard holder 49 which are disposed on the rear side of the feed holder 46, the work of attaching or detaching the feed holder 46 is made further easier.

Next, a sheet feeding device according to a second embodiment will be described. The sheet feeding device according to the second embodiment also includes the upper supporting frame 41, the lower supporting frame 43, the feed holder 46, the retard holder 49 and the stopper 50. The upper supporting frame 41 and the lower supporting frame 43 are respectively disposed on the upper side and the lower side of the main conveying path 33 (refer to FIG. 4). The feed holder 46 supports the pickup roller 44 and the feed roller 45 and is detachably supported on the upper supporting frame 41. The retard holder 49 supports the retard roller 48 and is detachably supported on the lower supporting frame 42. The stopper 50 prevents the retard holder 49 from being displaced. In the following description, a construction which is different from that of the first embodiment will be described.

Figure 16:
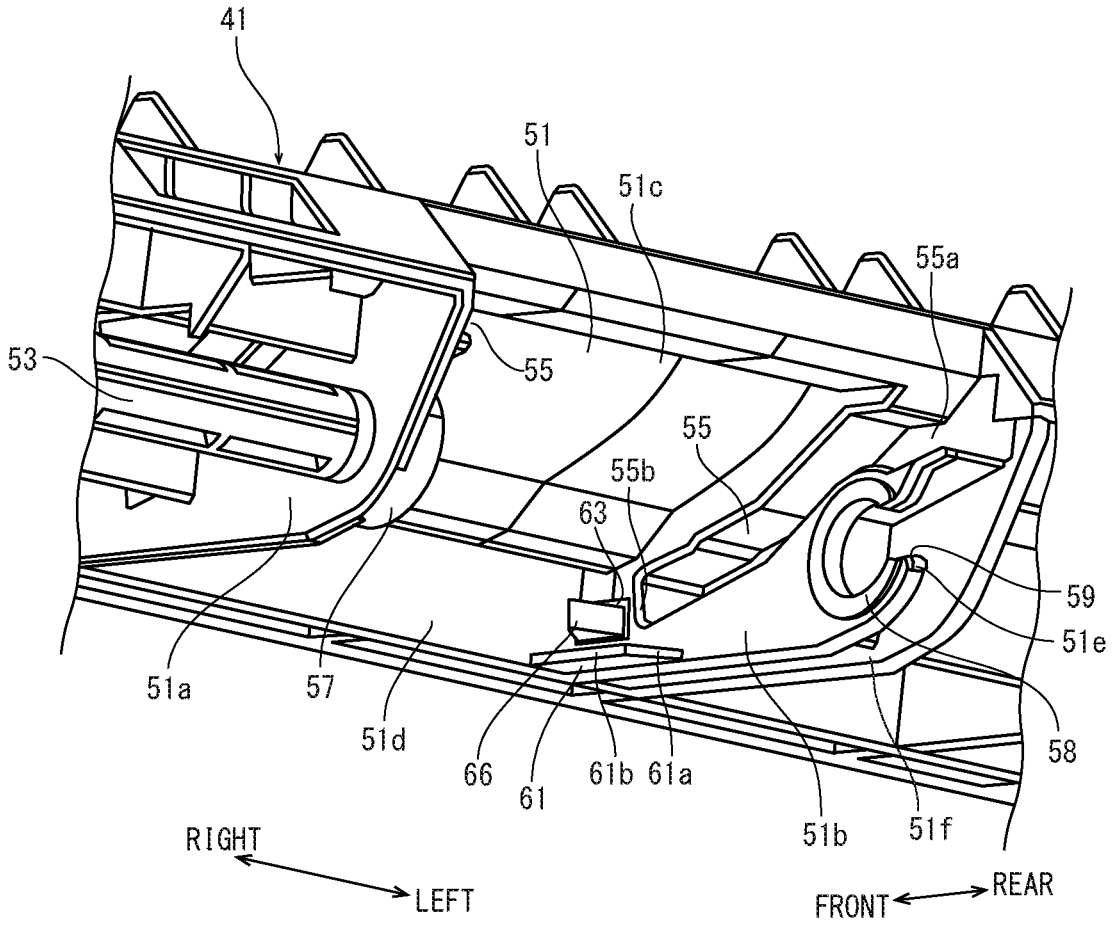
FIG. 16 is a perspective view showing a second side wall of an upper storage recessed part of an upper supporting frame in a sheet feeding device according to a second embodiment of the present disclosure.
Figure 17A:
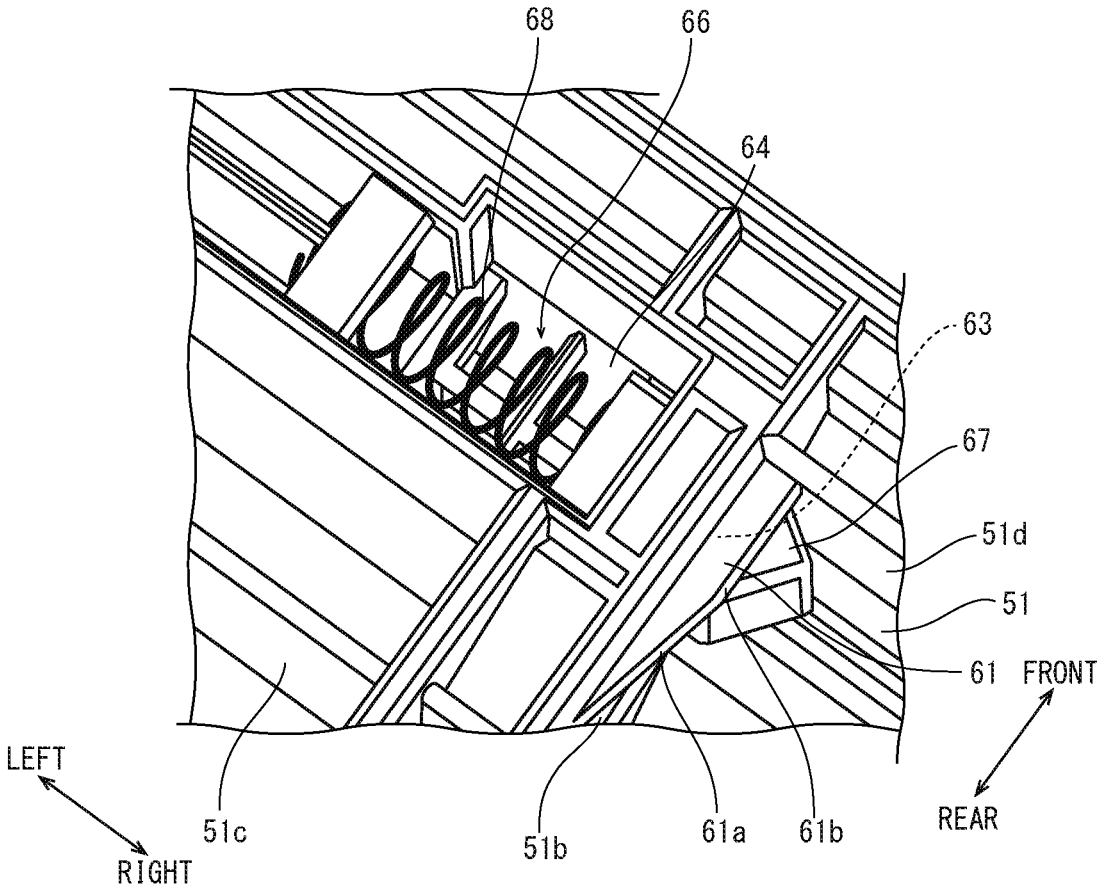
FIG. 17A is a perspective view showing a rib and a holder biasing member which are provided on the upper supporting frame, in the sheet feeding device according to the second embodiment of the present disclosure.
Figure 17B:
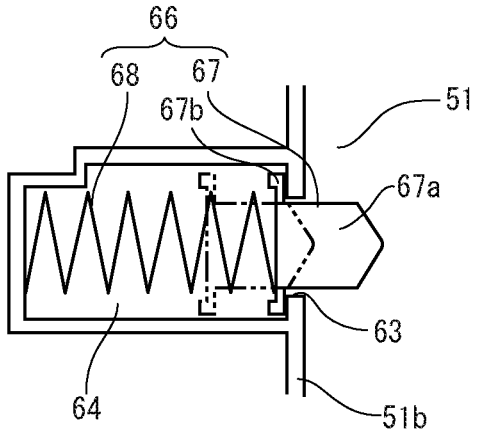
FIG. 17B is a plan view showing the holder biasing member provided on the upper supporting frame, in the sheet feeding device according to the second embodiment of the present disclosure.

With reference to FIG. 16 and FIG. 17A and FIG. 17B, the upper supporting frame 41 will be described. FIG. 16 is a perspective view showing the upper storage recessed part viewed from the rear right side; and FIG. 17A and FIG. 17B are views each showing a rib and a holder biasing member which are provided on an upper supporting frame.

As shown in FIG. 16, the second side wall 51*b* of the upper storage recessed part 51 is formed with a rib 61 at the front end portion. The rib 61 is formed as a pressing part configured to press the feed holder 46 rightward (on one side in the axial direction).

The rib 61 is formed along the lower edge of the second side wall 51*b* so as to protrude a substantially horizontal direction perpendicular to the second wall 51*b* and the front wall 51*d*. The rib 61 has an inclined edge 61*a* and a parallel edge 61*b*. The inclined edge 61*a* is inclined inward toward the front side. The parallel edge 61*b* is parallel to the second side wall 51*b*.

Further, the second side wall 51*b* is formed with an opening 63 above the rib 61 at the front end portion. As shown in FIG. 17A, on the depth side (the left side) of the opening 63, a hollow space 64 is formed. In the hollow space 64, a holder biasing member 66 is stored. The holder biasing member 66, as shown in FIG. 17B, has a pressing member 67 and a coil spring 68. The pressing member 67 is so provided as to be able to protrude through the opening 63 into the upper storage recessed part 51. The coil spring 68 biases the pressing member 67 in a direction protruding from the opening 63. The pressing member 67 has a shaft part 67*a* and a base part 67*b*. The shaft part 67*a* has a smaller cross section size than that of the opening 63. A tip end portion of the shaft part 67*a* is formed into a triangular plane shape. The base part 67*b* has a larger cross section size than that of the opening 63. The coil spring 68 is interposed between the base part 67*b* of the pressing member 67 and the hollow space 64 with a slightly compressed state.

The pressing member 67 is biased by the coil spring 68 in a direction toward the upper storage recessed part 51. The base part 67*b* is engagingly locked at the periphery of the opening 63 and the shaft part 67*a* protrudes into the upper storage recessed part 51 through the opening 63. If the pressing member 67 is pressed against a biasing force of the coil spring 68, the tip end portion of the shaft part 67*a* retracts from the upper storage recessed part 51 (refer to the double-dotted chain line of FIG. 17B).

In addition, in the second embodiment, the top wall 51*c* of the upper storage recessed part 51 is not formed with the locking piece 62 (refer to FIG. 5 and FIG. 6).

Figure 18A:
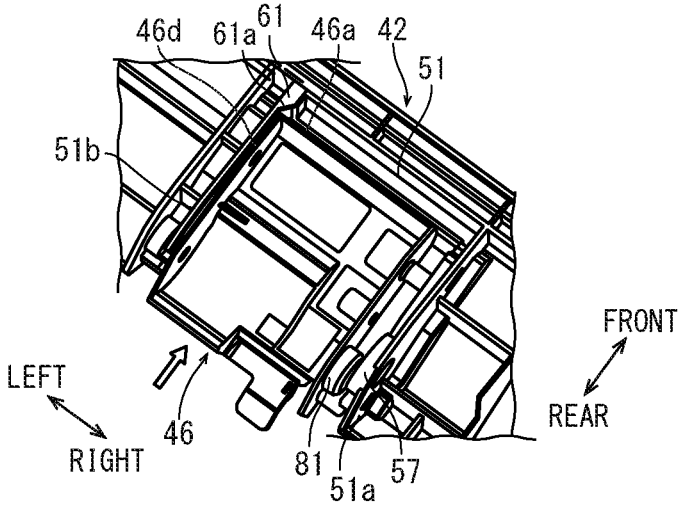
FIG. 18A is a perspective view showing a feed holder before abutting against the rib, in the sheet feeding device according to the second embodiment of the present disclosure.
Figure 18B:
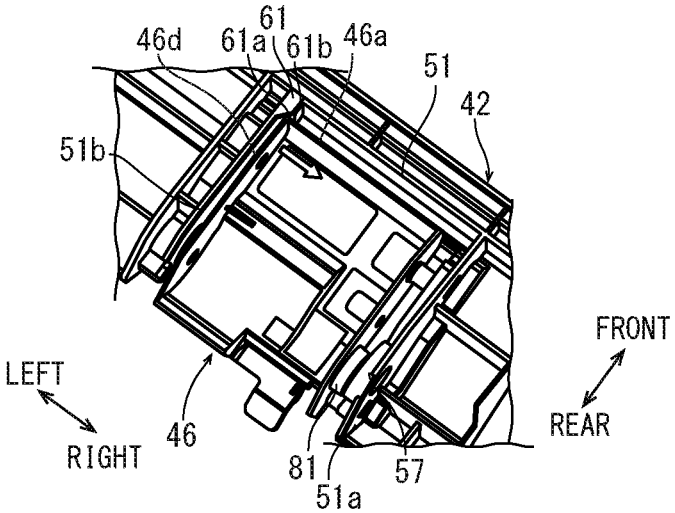
FIG. 18B is a perspective view showing the feed holder that starts to be guided in the axial direction by the rib, in the sheet feeding device according to the second embodiment of the present disclosure.
Figure 18C:
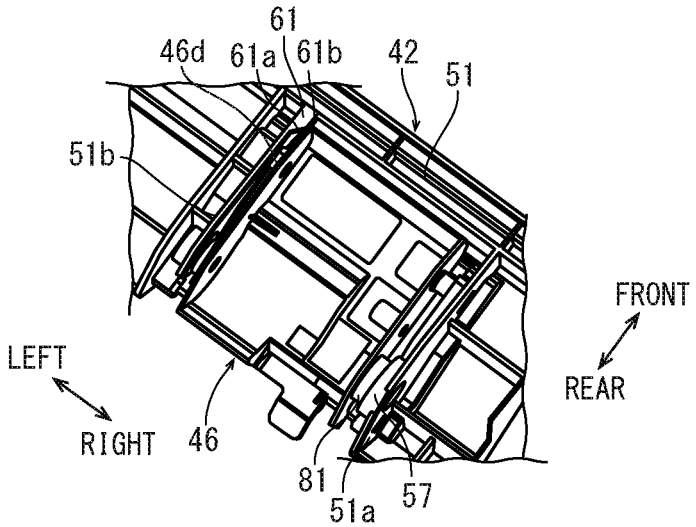
FIG. 18C is a perspective view showing the feed holder that is slid into the aligning position, in the sheet feeding device according to the second embodiment of the present disclosure.

The method of attaching the feed holder 46 to the upper storage recessed part 51 in the sheet feeding device 10 having the above construction will be described with reference to FIG. 10A and FIG. 10B; FIG. 18A, FIG. 18B and FIG. 18C; and FIG. 19A, FIG. 19B and FIG. 19C. FIG. 18A, FIG. 18B and FIG. 18C are perspective view each illustrating a process in which the feed holder is pushed; and FIG. 19A, FIG. 19B and FIG. 19C are perspective view each illustrating an engaging process between the driving shaft and the rotating shaft.

When the feed holder 46 is attached to the upper storage recessed part 51, the guiding shafts 55 (refer to FIG. 8) are engaged with the guide grooves 55 (refer to FIG. 5 and FIG. 6) from the opened ends 55*a* and then slid along the guide grooves 55 with the feed holder 46 sifted toward the second side wall 51*b* as close as possible. Then, the small diameter part 83 of the second boss 82 passes through the notch 59 and gets into the second bearing 58.

Then, as shown in FIG. 18A, a corner between the second side plate 46*d* and the front side plate 46*a* of the feed holder 46 abuts against the inclined edge 61*a* of the rib 61. Then, as shown in FIG. 18B, the feed holder 46 is pushed in a direction of the first side wall 51*a* (in one direction in the axial direction, in the rightward direction) along the inclined edge 61*a* of the rib 61 and then the first boss 81 starts to get into the first bearing 57. Also, the front end portion of the second side plate 46*d* of the feed holder 46 abuts against the tip end portion of the pressing member 67 of the holder biasing member 66 (refer to FIG. 16, FIG. 17A, and FIG. 17B). Then, the pressing member 67 is pressed into the hollow space 64 against the biasing force of the coil spring 68. In other words, the biasing force in the direction toward the first side wall 51*a* (the rightward direction) is applied to the feed holder 46 from the coil spring 68.

Figure 19A:
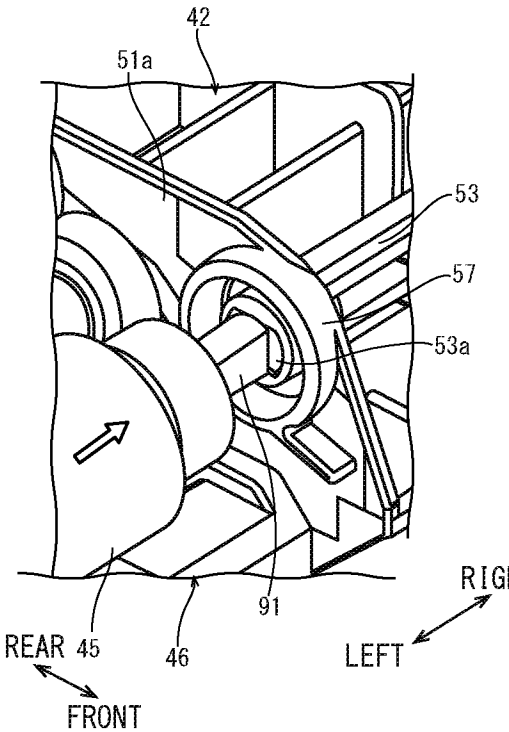
FIG. 19A is a perspective view showing the driving shaft and the rotating shaft which are abutted each other, in the sheet feeding device according to the second embodiment of the present disclosure.
Figure 19B:
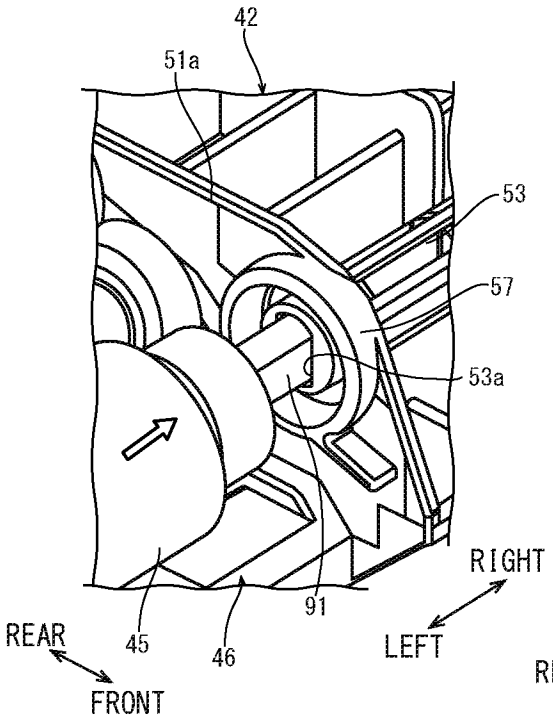
FIG. 19B is a perspective view showing the driving shaft and the rotating shaft in a state in which phases of an engagement hole and an engagement protrusion are made coincide with each other, in the sheet feeding device according to the second embodiment of the present disclosure.
Figure 19C:
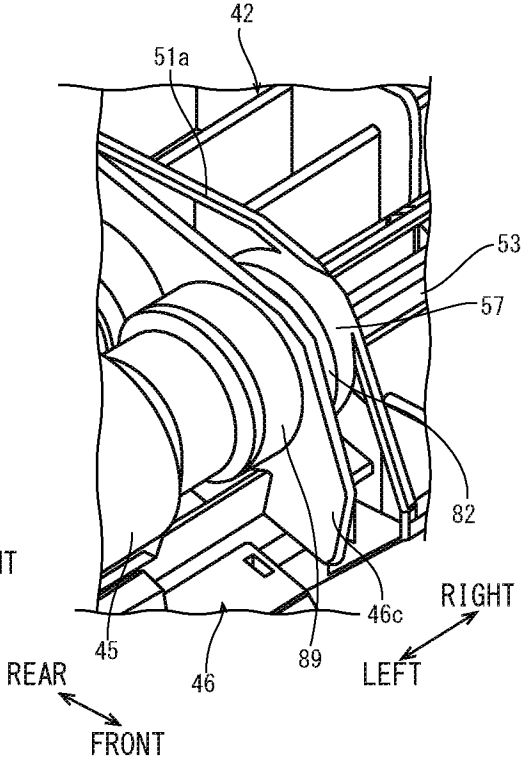
FIG. 19C is a perspective view showing the driving shaft and the rotating shaft in a state in which the engagement protrusion is engaged with the engagement hole, in the sheet feeding device according to the second embodiment of the present disclosure.

When the guide shafts 85 are further slid along the guide grooves 55 and, as shown in FIG. 18C, the corner between the second side plate 46*d* and the front side plate 46*a* of the feed holder 46 reaches the parallel edge 61*b* from the inclined edge 61*a* of the rib 61, the first boss 81 is fitted into the first bearing 57 and, as shown in FIG. 19A, the end face of the engagement protrusion 91 of the rotating shaft 45*b* is pressed against the end face of the driving shaft 53. Incidentally, in this state, the engagement protrusion 91 does not always need to engage with the engagement hole 53*a*. However, in a case where phases of the engagement protrusion 91 and the engagement hole 53*a* may be made coincide with each other, the engagement protrusion 91 and the engagement hole 53*a* may be engaged with each other when the feed holder 46 is pushed by the rib 61.

Further, one of the curved side faces 83*a* of the small diameter part 83 of the second boss 82 abuts against the inner circumferential face of the second bearing 58 and then the sliding of the feed holder 46 is restricted. In this manner, as shown in FIG. 10A, the feed holder 46 is positioned in the aligning position where the rotating shaft 45*b* and the driving shaft 53 are aligned in the axial direction.

After the feed holder 46 is attached to the upper storage recessed part 51, the retard holder 49 and the stopper 50 are attached to the lower storage recessed part 71. When the feed holder 46 and the retard holder 49 are attached, an uppermost sheet S among the sheets stacked on the lift plate 9*a* biased upward by the spring member 9*b* of the sheet feeding cartridge 9 is brought into pressure contact with the pickup roller 44 supported in the feed holder 46.

Afterwards, if the driving shaft 53 is driven to be rotated at a predetermined angle, as shown in FIG. 19B, the phases of the engagement hole 53*a* of the driving shaft 53 and the engagement protrusion 91 of the rotating shaft 45*b* of the feed roller 45 are made coincide with each other. Since the feed holder 46 is biased in the direction toward the first side wall 51*a* (the rightward direction) by the holder biasing member 66, if the phases of the engagement hole 53*a* and the engagement protrusion 91 are made coincide with each other, as shown in FIG. 19C, the feed holder 46 moves in the direction toward the first side wall 51*a* and then the engagement protrusion 91 engages with the engagement hole 53*a*. In this manner, the rotating shaft 45*b* is coupled to the driving shaft 53 so as to be integrally rotatable. Then, the rotating shaft 45*b* is rotated and then to rotate the feed roller 45. Further, via the idle gear 87, the pickup roller 44 rotates in the same direction as that of the feed roller 45. By rotation of the pickup roller 44, the sheet S is fed out from the sheet feeding cassette 9 to a gap between the feed roller 45 and the retard roller 48. Incidentally, the driving shaft 53 may be manually rotated until the phases of the engagement hole 53*a* and the engagement protrusion 91 are made coincide with each other.

As described hereinabove, in the sheet feeding device 10 according to a second embodiment of the present disclosure, when the feed holder 46 is slide into the aligning position along the guide groove 55, the feed holder 46 is guided by the rib 61 in the one side direction in the axial direction of the rotating shaft 45*b* of the feed roller 45 and then the rotating shaft 45*b* of the feed roller 45 is pressed against the driving shaft 53. Then, by rotating the driving shaft 53 at the aligning position, the engagement protrusion 91 of the rotating shaft 45*b* of the feed roller 45 is engaged with the engagement hole 53*a* of the driving shaft 53 each other and then the rotating shaft 45*b* of the feed roller 45 is automatically coupled to the driving shaft 53 each other so as to be integrally rotatable. Therefore, the work of attaching the feed holder 46 is simplified. Specifically, merely by sliding the feed holder 46 along the guide grooves 55, the rotating shaft 45*b* of the feed roller 45 can be coupled to the driving shaft 53 each other so as to be integrally rotatable.

In addition, the holder biasing member 66 to bias the feed holder 46 in the one side direction of the axial direction makes it possible to surely engage the engagement protrusion 91 with the engagement hole 53*a* each other. Incidentally, in a case where the holder biasing member 66 may not be provided, if the phases of the engagement hole 53*a* and the engagement protrusion 91 are made coincide with each other, the engagement protrusion 91 engages with the engagement hole 53*a* by a length of elastically deformed portions of the rotating shaft 45*b* and the driving shaft 53 which are pressed each other by the rib 61.

Figure 20:
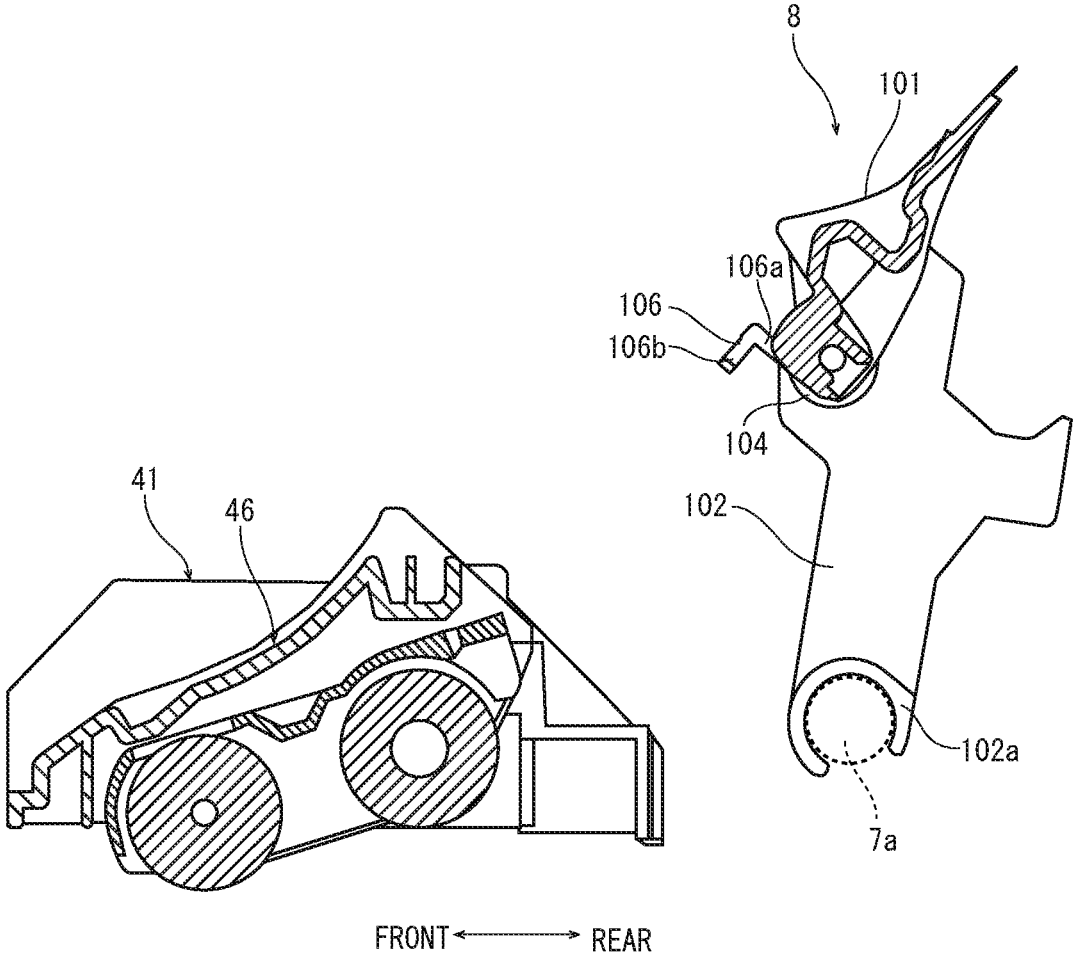
FIG. 20 is a sectional view showing an intermediate guide turned rearward and the upper supporting frame, in the sheet feeding device according to the second embodiment of the present disclosure.

Next, the intermediate guide 8 and the upper supporting frame 41 in the second embodiment will be described with reference to FIG. 20 to FIG. 22. FIG. 20 is a side sectional view showing the intermediate guide turned rearward and the upper supporting frame, FIG. 21 is a side sectional view showing the intermediate guide turned forward and the upper supporting frame and FIG. 23 is a front view showing the intermediate guide turned forward and the upper supporting frame.

The intermediate guide 8 has a guide part 101 and a pair of arms 102. The guide part 101 is provided along the width direction. The pair of arms 102 are provided at both side end portions of the guide part 101 in the width direction.

Figure 21:
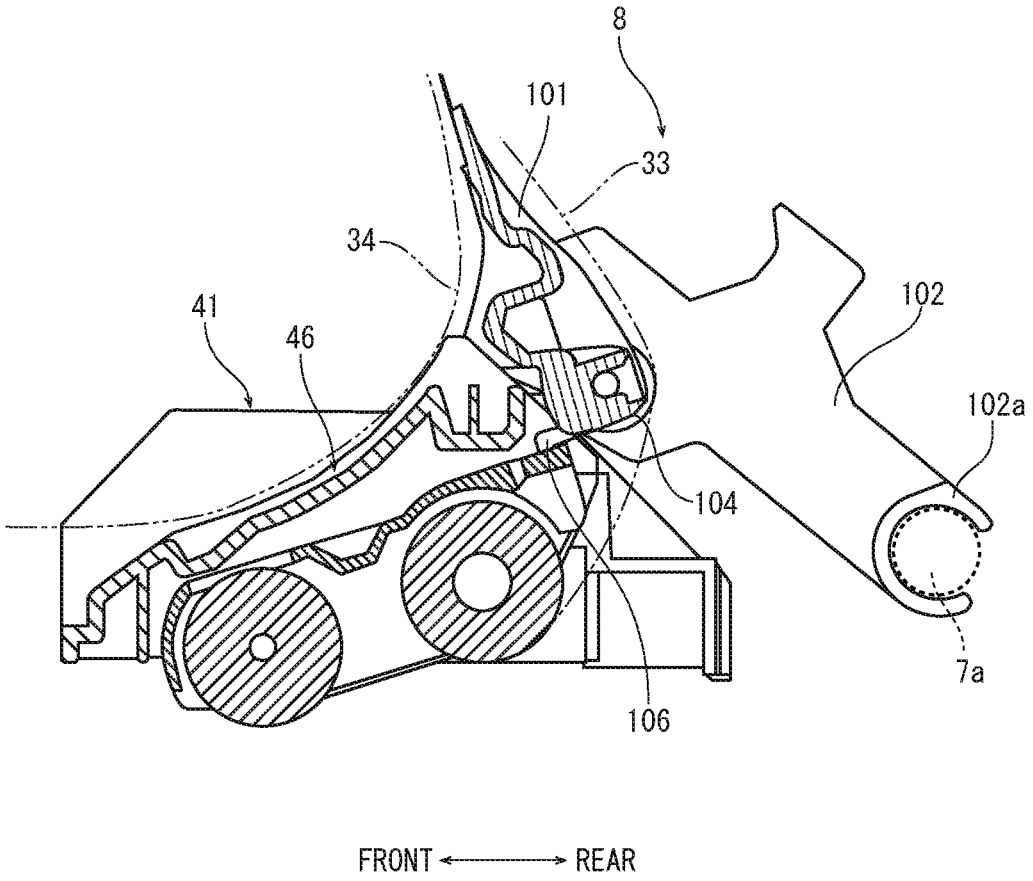
FIG. 21 is a sectional view showing the intermediate guide turned forward and the upper supporting frame, in the sheet feeding device according to the second embodiment of the present disclosure.

As shown in FIG. 20 and FIG. 21, the guide part 101 has a wedge-like section tapered toward on the downstream side in the conveying direction. On the rear face of the guide part 101, a guide face of the main conveying path 33 is formed. On the front face of the guide part 101, a guide face of the manual bypass conveying path 34 is formed. On the lower end portion of the front face, three rollers 104 are rotatably supported. One roller 104 is disposed at the center portion in the width direction and two rollers 104 are respectively disposed at the both side portions in the width direction.

The guide part 101 is formed with a restriction rib 106 on the lower face. As shown in FIG. 22, the restriction rib 106 protrudes from a position on the slightly left side from the center portion in the width direction. The restriction rib 106 has an L-shaped side section having a base part 105*a* and a front part 105*b*. The base part 105*a* protrudes toward the front face of the guide part 101. The front part 105*b* bents downward from the tip end of the base part 105*a*.

The pair of arms 101 are respectively formed with a C-shaped bearing 102*a*. The bearings 102*a* are rotatably supported to the supporting shafts 7*a* (refer to FIG. 2) of the conveying unit 7. The intermediate guide 8 is turnable forward and rearward around the supporting shafts 7*a*.

When the intermediate guide 8 is turned forward, as shown in FIG. 21, the pair of arms 102 are abut against the both side end portions of the upper supporting frame 41. Then, the lower face of the upper supporting frame 41 and the rear face of the intermediate guide 8 form the main conveying path 33 extending upward with curving rightward. In addition, the upper face of the upper supporting frame 41 and the front face of the intermediate guide 8 form the manual bypass conveying tray 34 extending upward with curving rearward.

Figure 22:
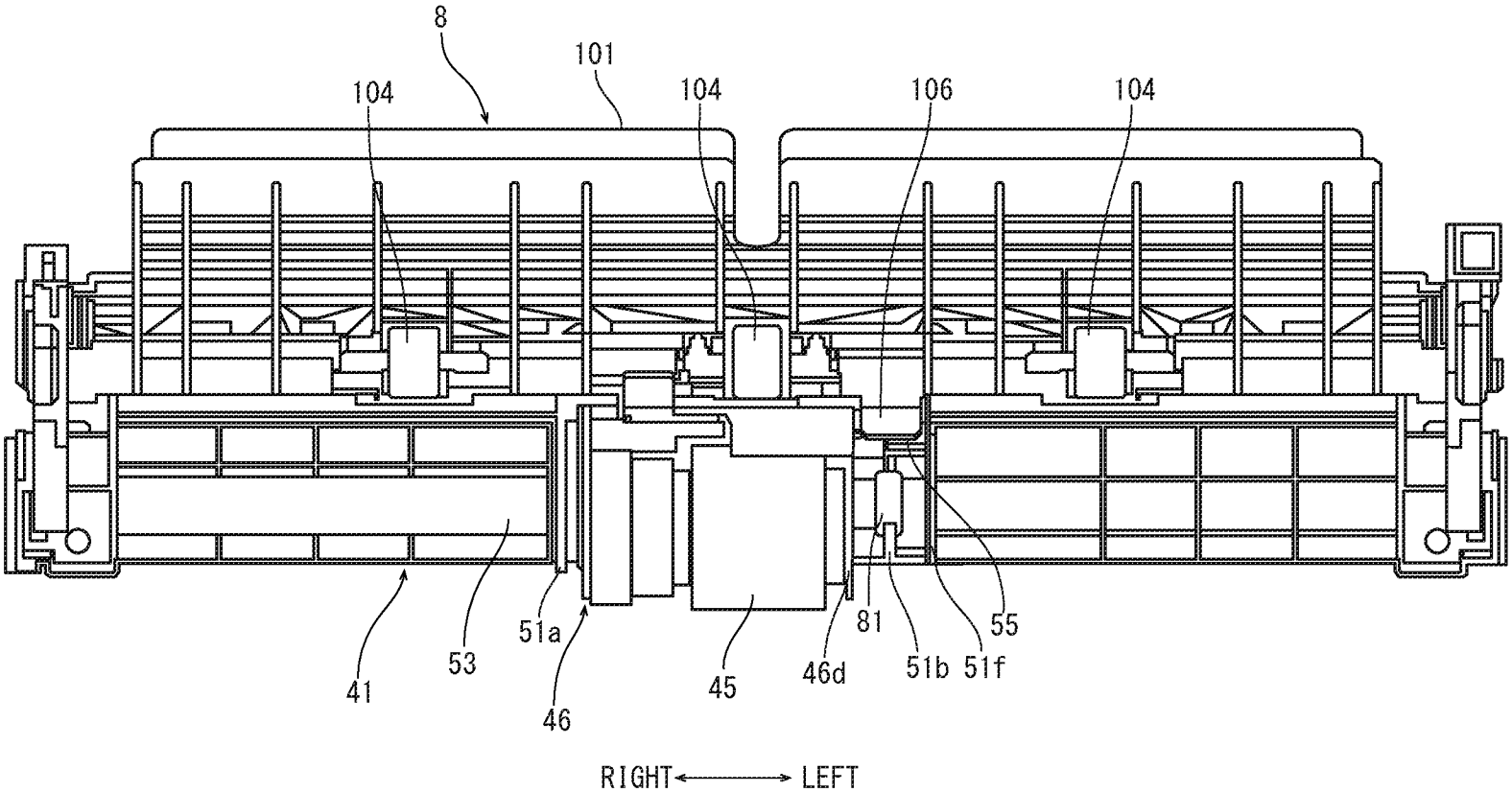
FIG. 22 is a front view showing the intermediate guide turned forward and the upper supporting frame, in the sheet feeding device according to the second embodiment of the present disclosure.

In addition, as shown in FIG. 22, the restriction rib 106, mainly the front part 106*b*, enters a space between the third side wall 51*f* of the upper storage recessed part 51 and the second side plate 46*d* of the feed holder 46, and the guide groove 55.

When the restriction rib 106 enters the space between the third side wall 51*f* and the feed holder 46, the feed holder 46 stored in the upper storage recessed part 51 is prevented from being moved in the leftward direction (in a direction toward the second wall 51*b*). The rib 106 does not necessarily have to enter in the space between the third side wall 51*f* and the second side plate 4 6*d* of the feed holder 46 when the intermediate guide 8 is tuned forward; preferably enters in a space on the left side of the feed holder 46 so as to be close to the second side plate 46*d*.

The feed holder 46 is pushed rightward by the holder biasing member 66 and the rotating shaft 45*b* of the feed roller 45 is coupled to the driving shaft 53 so as to be integrally rotatable. In order to push the feed holder 46 rightward, a width of the upper storage recessed part 51 in the left and right directions is made to be wider than a width of the feed holder 46 in the left and right directions, as shown in FIG. 10A and FIG. 10B. Therefore, after the feed holder 46 is moved in the rightward direction (in the direction toward the first side wall 51*a*) in the upper storage recessed part 51, a space is produced on the right side of the second side wall 51*b* as shown in FIG. 10B.

Accordingly, if a stronger force than the biasing force of the holder biasing member 66 is applied to the feed holder 46 during the transportation or the like, the second boss 82 may be detached leftward from the second bearing 58 and then the feed holder 46 maybe therefore displaced leftward.

However, as shown in FIG. 21 and FIG. 22, if the restriction rib 106 enters the space between the second side wall 51*b* and the feed holder 46 by turning the intermediate guide 8 forward, in a case in which the feed holder 46 may be displaced leftward, the second side plate 46*d* of the feed holder 46 is abut against the restriction rib 106 so that the displacement of the feed holder 46 leftward can be prevented. Accordingly, if an impact may be applied, the feed holder 46 can be supported to the upper storage recessed part 51 without displacing. Since the space on the left side of the feed holder 46 is an original space formed in order to move the feed holder 46 rightward, a space of the upper storage recessed part 51 can be efficiently used. Since a distance between the second side plate 46*d* of the feed holder 46 and the third side wall 51*f* is relatively wide, the rib 106 may enter the space on the left side of the feed holder 46 so as to be close to the second side plate 46*d* without requiring high dimensional accuracy.

The restriction rib 106 may be formed to the conveying unit 7 or the rear cover 6.

While the preferable embodiment and its modified example of the sheet feeding device and the image forming apparatus of the present disclosure have been described above and various technically preferable configurations have been illustrated, a technical range of the disclosure is not to be restricted by the description and illustration of the embodiment. Further, the components in the embodiment of the disclosure may be suitably replaced with other components, or variously combined with the other components. The claims are not restricted by the description of the embodiment of the disclosure as mentioned above.

What is claimed is:

1. A sheet feeding device comprising:

a pickup roller configured to feed a sheet;

a feed roller configured to rotate around a rotating shaft so as to convey the sheet fed by the pickup roller;

a feed holder configured to support the pickup roller and the feed roller;

a supporting frame having a storage recessed part in which the feed holder is supported so as to be attachable and detachable along a direction crossing an axial direction of the rotating shaft; and a driving shaft rotatably supported to the supporting frame on one side of the storage recessed part in the axial direction, the driving shaft being configure to be coupled to the rotating shaft so as to transmit a driving force to the rotating shaft, wherein the storage recessed part includes:

a first side wall and a second side wall opposing to each other in the axial direction and extending along the attachment/detachment direction of the feed holder, the first side wall being on the one side in the axial direction and the second side wall being on the other side in the axial direction;

a guide part provided on each of the first side wall and the second side wall along the attachment/detachment direction and configured to slidably guide the feed holder; and a positioning part provided on either one of the first side wall and the second side wall and configured to position the feed holder guided along the guide part at an aligning position in which the driving shaft and the rotating shaft are aligned on the axis direction, wherein the rotating shaft is coupled to the driving shaft by sliding the feed holder positioned at the aligning position by the positioning part in the axial direction, wherein the second side wall is provided with a pressing part, the pressing part is configured to push the feed holder in the one side in the axial direction while the feed holder is sliding into the aligning position and to couple the rotating shaft to the driving shaft.

2. The sheet feeding device according to claim 1, wherein the rotating shaft includes an engaging part on one end face, the driving shaft includes an engaged part on one end face and the engaging part and the engaged part are engaged with each other to couple the rotating shaft and the driving shaft so as to be integrally rotatable, wherein the storage recessed part has a holder biasing member configured to bias the feed holder positioned at the aligning position on the one side in the axial direction and to press the engaging part against the engaged part, wherein, in a case where the driving shaft rotates and then a phase of the engaging part is made coincide with a phase of the engaged part, the engaging part and the engaged part are engaged with each other so that the rotating shaft and the driving shaft are coupled to each other.

3. The sheet feeding device according to claim 1, wherein the feed holder includes a first side plate and a second side plate opposing to each other in the axial direction, the first side plate being on the one side in the axial direction and the second side plate being on the other side in the axial direction, the first side plate has a first boss through which an end portion on the one side in the axial direction of the rotating shaft is passed, the first boss being supported on the first side wall at the aligning position and the second side plate has a second boss through which an end portion on the other side in the axial direction of the rotating shaft is passed, the second boss being supported on the second side wall at the aligning position, wherein the positioning part is a second bearing provided on the second side wall so as to support the second boss rotatably.

4. The sheet feeding device according to claim 3, wherein the second boss includes a small diameter part formed by cutting a part of a proximal end portion of the second boss along the circumferential direction, the second bearing includes a notch cut out along a direction crossing the axial direction so that the small diameter part can pass through and wherein when the feed holder is slid along the guide part and then the small diameter part is inserted into the second bearing through the notch, an outer circumferential face of the small diameter part abuts against an inner circumferential face of the second bearing so that the feed holder is prevented from being slid along the guide part and is positioned at the aligning position.

5. The sheet feeding device according to claim 3, wherein the small diameter part includes a pair of curved side faces curving in an arc shape and a pair of flat side faces, an outer diameter of the pair of curved side faces is larger than a width of the notch and has a size capable of clearance fitting into the second bearing, and a distance between the pair of flat side faces is smaller than the width of the notch, wherein one of the pair of curved side face abuts on the inner circumferential face of the second bearing so that the sheet feeding holder is positioned at the aligning position.

6. The sheet feeding device according to claim 1, wherein the storage recessed part includes a locking part and the feed holder includes a locked part which is locked with the locking part, wherein after the feed holder is slid in the axial direction until the rotating shaft and the driving shaft are coupled to each other, the locking part locks the locked part to prevent the sliding of the feed holder in the axial direction.

7. The sheet feeding device according to claim 6, wherein the locking part is a locking piece protruding from a top wall of the storage recessed part and the locked part is a lever provided on the feed holder so as to be elastically deformable, the lever having a locked protrusion protruding upward on a tip end portion, wherein the locked protrusion is locked or unlocked with the locking piece by elastically deforming the lever upward or downward.

8. An image forming apparatus comprising:

the sheet feeding device according to claim 1, a conveying path along which a sheet fed by the sheet feeding device is conveyed and an image forming unit that forms images on the sheet conveyed along the conveying path.

9. The image forming apparatus according to claim 8, comprising an opening or closing unit provided so as to be turnable around the lower end portion and configured to open and close the conveying path on the downstream side from the sheet feeding device in the conveying direction, wherein the opening or closing unit has a restriction part configured to prevent the feed holder from being displaced in the other side in the axial direction when the opening or closing unit is turned to close the conveying path.

10. The image forming apparatus according to claim 9, wherein the restriction part is a rib configured to enter a space on the other side of the feed holder in the axial direction and the rib abuts against the feed holder so that the feed holder can be prevented from being slid in the other side in the axial direction.

11. The image forming apparatus according to claim 10, wherein the supporting frame includes a third side wall opposing to the second side wall on the other side in the axial direction and the rib is configured to enter a space between the third side wall and the feed holder.

12. The image forming apparatus according to claim 8, wherein the opening or closing unit includes a notch along a lower edge so as to correspond to the feed holder and when the conveying unit is turned to open the conveying path, the feed holder is attachable/detachable through the notch.

* * * * *